US010833396B2

(12) United States Patent
Li et al.

(10) Patent No.: US 10,833,396 B2
(45) **Date of Patent: *Nov. 10, 2020**

(54) ELECTRONIC DEVICE

(71) Applicant: Huawei Device Co., Ltd., Guangdong (CN)

(72) Inventors: Jianming Li, Shanghai (CN); Kun Feng, Shanghai (CN); Xuefei Zhang, Shenzhen (CN); Hanyang Wang, Reading (GB)

(73) Assignee: HUAWEI DEVICE CO., LTD., Dongguan (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/377,990

(22) Filed: Apr. 8, 2019

(65) Prior Publication Data

US 2019/0237854 A1 Aug. 1, 2019

Related U.S. Application Data

(63) Continuation of application No. 15/124,449, filed as application No. PCT/CN2015/073649 on Mar. 4, 2015, now Pat. No. 10,290,922.

(30) Foreign Application Priority Data

Mar. 21, 2014 (CN) ..... 2014 1 0109571

(51) Int. Cl.
*H01Q 1/24* (2006.01)
*H01Q 9/42* (2006.01)
(Continued)

(52) U.S. Cl.
CPC ..... *H01Q 1/243* (2013.01); *H01Q 1/48* (2013.01); *H01Q 1/50* (2013.01); *H01Q 5/328* (2015.01); *H01Q 5/335* (2015.01); *H01Q 9/42* (2013.01)

(58) Field of Classification Search
CPC ..... H01Q 1/243; H01Q 1/50; H01Q 1/48; H01Q 5/335; H01Q 5/328; H01Q 9/42
See application file for complete search history.

(56) References Cited

U.S. PATENT DOCUMENTS 10,290,922 B2 * 5/2019 Li ..... H01Q 1/243
2003/0025637 A1 2/2003 Mendolia et al.
(Continued)

FOREIGN PATENT DOCUMENTS

CN 102956954 A 3/2013
CN 103296385 A 9/2013
(Continued)

OTHER PUBLICATIONS

International Search Report (including English translation) issued in corresponding International Application No. PCT/CN2015/073649, dated Jun. 12, 2015, 6 pages.
(Continued)

*Primary Examiner* — Dieu Hien T Duong
(74) *Attorney, Agent, or Firm* — Conley Rose, P.C.

(57) ABSTRACT

An electronic device includes a metal frame, an antenna feeding point, an antenna ground, a feeding branch, a grounding branch, an antenna resonance arm, a variable capacitor, and a control circuit. The antenna resonance arm is a part of the metal frame after segmentation, the antenna feeding point is disposed on the feeding branch, a first connection portion and a second connection portion are disposed on the antenna resonance arm, the feeding branch is disposed between the second connection portion and the antenna ground, the grounding branch is disposed between the first connection portion and the antenna ground, the variable capacitor is disposed on the feeding branch, the variable capacitor is disposed between the antenna feeding point and the second connection portion, and the control
(Continued)

circuit is configured to adjust a capacitance of the variable capacitor.

31 Claims, 24 Drawing Sheets

(51) Int. Cl.

| | |
|---|---|
| ***H01Q 5/328*** | (2015.01) |
| ***H01Q 5/335*** | (2015.01) |
| ***H01Q 1/48*** | (2006.01) |
| ***H01Q 1/50*** | (2006.01) |

(56) References Cited

U.S. PATENT DOCUMENTS

| | | | |
|---|---|---|---|
| 2004/0041734 | A1 | 3/2004 | Shiotsu et al. |
| 2009/0167617 | A1 | 7/2009 | Nishio et al. |
| 2012/0229346 | A1 | 9/2012 | Chen et al. |
| 2012/0229347 | A1 | 9/2012 | Jin et al. |
| 2012/0299785 | A1 | 11/2012 | Bevelacqua |
| 2013/0099996 | A1 | 4/2013 | Tseng et al. |
| 2013/0113677 | A1 | 5/2013 | Boyle et al. |
| 2013/0154897 | A1 | 6/2013 | Sorensen et al. |
| 2013/0169490 | A1 | 7/2013 | Pascolini et al. |
| 2013/0194139 | A1 | 8/2013 | Nickel et al. |
| 2013/0201067 | A1 | 8/2013 | Hu et al. |
| 2013/0203364 | A1 | 8/2013 | Darnell et al. |
| 2013/0214979 | A1 | 8/2013 | McMilin et al. |
| 2014/0131455 | A1 | 5/2014 | Takigahira |

FOREIGN PATENT DOCUMENTS

| | | | |
|---|---|---|---|
| CN | 103337702 | A | 10/2013 |
| CN | 103346397 | A | 10/2013 |
| CN | 203242747 | U | 10/2013 |
| CN | 103441331 | A | 12/2013 |
| WO | 2010095803 | A1 | 8/2010 |
| WO | 2010120218 | A1 | 10/2010 |
| WO | 2013012078 | A1 | 1/2013 |

OTHER PUBLICATIONS

Chinese Search Report issued in corresponding Chinese Application No. 201410109571.9, dated Dec. 8, 2015, 6 pages.

First Office Action (including English translation) issued in corresponding Chinese Patent Application No. 201410109571.9, dated Feb. 24, 2016, 13 pages.

Extended European Search Report issued in corresponding EP Application No. 15765228, dated Jan. 31, 2017, 8 pages.

* cited by examiner freq. (500 MHz-1.2 GHz)

freq. (0.5 GHz-3 GHz)

freq. (500 MHz-1.2 GHz)

freq. (500 MHz-1.2 GHz)

freq. (0.5 GHz-1.2 GHz)

freq. (1.5 GHz-3.0 GHz)

freq. (500 MHz-3 GHz)

ELECTRONIC DEVICE

CROSS-REFERENCE TO RELATED APPLICATIONS

This application is a continuation of U.S. patent application Ser. No. 15/124,449 filed on Sep. 8, 2016, which is a National Stage of International Patent Application No. PCT/CN2015/073649 filed Mar. 4, 2015, which claims priority to Chinese Patent Application No. 201410109571.9 filed on Mar. 21, 2014. All of the aforementioned patent applications are hereby incorporated by reference in their entireties.

TECHNICAL FIELD

The present disclosure relates to the field of communications technologies, and in particular, to an electronic device.

BACKGROUND

Today, electronic devices, such as a mobile phone, a personal digital assistant (PDA), and a tablet computer, require a display proportion to be increased and an apparatus volume to be reduced for pursuit of an appearance fashion sense, a touch sense and a visual sense. Correspondingly, under such a requirement, space to contain an antenna also becomes smaller.

In this environment, efficiency and a bandwidth of the antenna are more difficult to be implemented. In addition, recently, the electronic devices tend to be designed thinner and integrated with metal elements. A bandwidth and radiation effectiveness of antennas designed in a conventional manner are affected because of shielding of the metal elements. Therefore, a non-metal material has to be used as an antenna carrier or an antenna cover in an antenna area. In this way, appearance design of a product is affected. Therefore, how to give attention to both the bandwidth and efficiency of the antenna, and keep an appearance uniformity of a metal frame of a whole device is a technology that desperately needs to be broken through.

SUMMARY

Implementation manners of the present disclosure provide an electronic device, which can give attention to both a bandwidth and efficiency of an antenna, and keep an appearance uniformity of a metal frame of the whole device.

A first aspect provides an electronic device, where the electronic device is provided with a metal frame, the electronic device further includes an antenna feeding point, an antenna ground, a feeding branch, a grounding branch, an antenna resonance arm, a variable capacitor, and a control circuit, the antenna resonance arm is a part of the metal frame after segmentation, the antenna feeding point is disposed on the feeding branch, a first connection portion and a second connection portion are disposed on the antenna resonance arm, the first connection portion is disposed on a first end portion of the antenna resonance arm, the second connection portion is disposed between the first end portion and a second end portion of the antenna resonance arm, the feeding branch is disposed between the second connection portion and the antenna ground, the grounding branch is disposed between the first connection portion and the antenna ground, the variable capacitor is disposed on the feeding branch, the variable capacitor is disposed between the antenna feeding point and the second connection portion, and the control circuit is configured to adjust a capacitance of the variable capacitor.

In a first possible implementation manner of the first aspect, the electronic device further includes a short grounding branch provided with a controlled switch, a third connection portion is further disposed on the antenna resonance arm, the third connection portion is between the first connection portion and the second connection portion, the short grounding branch is disposed between the third connection portion and the antenna ground, and the control circuit is further configured to control the controlled switch to be switched off or switched on.

With reference to the first possible implementation manner of the first aspect, in a second possible implementation manner, the electronic device further includes an inductor arranged in parallel to the controlled switch.

With reference to the second possible implementation manner of the first aspect, in a third possible implementation manner, an inductance of the inductor includes 5 nanoHenry (nH), 12 nH, and 11 nH.

In a fourth possible implementation manner of the first aspect, the capacitance includes 0.7 picoFarad (pF), 1.2 pF, 1.7 pF, 2.2 pF, and 2.7 pF.

In a fifth possible implementation manner of the first aspect, the electronic device further includes a short grounding branch provided with a filter, a third connection portion is further disposed on the antenna resonance arm, the third connection portion is between the first connection portion and the second connection portion, the short grounding branch is disposed between the third connection portion and the antenna ground, and the filter has a low-frequency-band high-impedance characteristic and a high-frequency-band low-impedance characteristic.

With reference to the fifth possible implementation manner of the first aspect, in a sixth possible implementation manner, the electronic device further includes an inductor arranged in parallel to the filter.

With reference to any one of the first aspect, and the first to sixth possible implementation manners of the first aspect, in a seventh possible implementation manner, the electronic device is cuboid, and the metal frame is ring-shaped and is disposed on four side walls of the electronic device.

With reference to any one of the first aspect, and the first to sixth possible implementation manners of the first aspect, in an eighth possible implementation manner, a distance between the first connection portion and the second connection portion is less than one eighth of a wavelength of a low-frequency resonance frequency.

With reference to any one of the first aspect, and the first to sixth possible implementation manners of the first aspect, in a ninth possible implementation manner, the antenna further includes a capacitor connected in parallel to the antenna feeding point.

With reference to any one of the first aspect, and the first to sixth possible implementation manners of the first aspect, in a tenth possible implementation manner, the antenna further includes an inductor connected in series with the antenna feeding point.

With reference to any one of the first aspect, and the first to sixth possible implementation manners of the first aspect, in an eleventh possible implementation manner, the antenna resonance arm further has a fourth connection portion disposed between the first connection portion and the second connection portion, the antenna further includes a capacitor disposed between the fourth connection portion and the antenna ground, and the fourth connection portion is connected to the antenna ground using the capacitor.

In the electronic device provided in the embodiments of the present invention, a metal frame is used as an antenna resonance arm, so that a solution of an adjustable antenna of the electronic device that is provided with the metal frame is implemented. In this way, not only appearance design of the electronic device can be better preserved, but also modifications on the metal frame can be avoided. Only a capacitance of a variable capacitor needs to be adjusted during debugging, greatly simplifying a debugging difficulty. In addition, high-frequency and low-frequency resonance frequencies of the present invention share a part of the metal frame as the antenna resonance arm, and do not need to additionally use another metal frame to generate another frequency resonance, which can greatly reduce space needed by the antenna, thereby overcoming a technical problem of giving attention to both a bandwidth and efficiency of the antenna, and keeping an appearance uniformity of the metal frame of the whole device.

DETAILED DESCRIPTION

The following describes the present disclosure in detail with reference to accompanying drawings and implementation manners.

Embodiment 1

Figure 1:
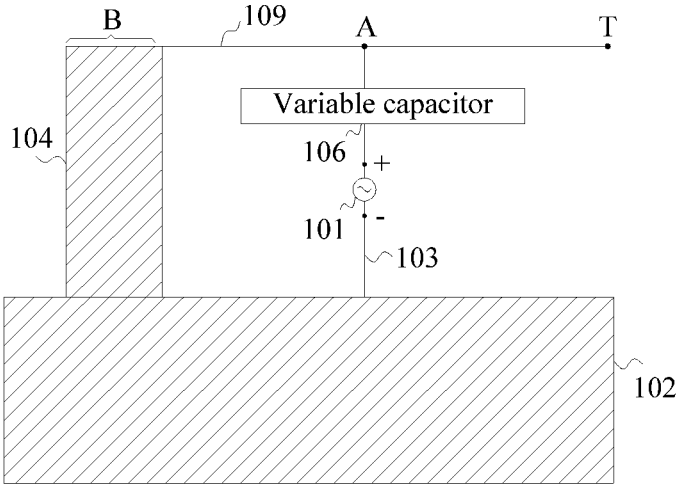
FIG. 1 is a schematic structural diagram of a first embodiment of an electronic device according to the present disclosure.

Referring to FIG. 1, FIG. 1 is a schematic structural diagram of a first embodiment of an electronic device according to the present disclosure. As shown in FIG. 1, this embodiment of the present disclosure provides an electronic device, where the electronic device is provided with a metal frame, the electronic device further includes a feeding source 101, an antenna feeding point +, an antenna ground 102, a feeding branch 103, a grounding branch 104, an antenna resonance arm 109, a variable capacitor 106, and a control circuit (not shown), the antenna feeding point + is a positive electrode of the feeding source 101, the antenna resonance arm 109 is a part of the metal frame after segmentation, the antenna feeding point + is disposed on the feeding branch 103, a first connection portion B and a second connection portion A are disposed on the antenna resonance arm 109, the first connection portion B is disposed on a first end of the antenna resonance arm 109, the second connection portion A is disposed between the first end and a second end T of the antenna resonance arm 109, the feeding branch 103 is disposed between the second connection portion A and the antenna ground 102, the grounding branch 104 is disposed between the first connection portion B and the antenna ground 102, the variable capacitor 106 is disposed on the feeding branch 103, and specifically, disposed between the antenna feeding point + and the second connection portion A, and the control circuit is configured to adjust a capacitance of the variable capacitor 106.

In this embodiment, a distributed inductor is formed between the first connection portion B and the second connection portion A. A part between the first connection portion B and the second connection portion A on the antenna resonance arm 109 may be used as an antenna radiator to send or receive a first frequency signal. The antenna feeding point +, the variable capacitor 106, the distributed inductor formed between the first connection portion B and the second connection portion A, and the antenna ground 102 are in line with a left hand transmission line principle. Impedance matching of the antenna resonance arm 109 may be adjusted by changing the capacitance of the variable capacitor 106, so as to adjust a resonance frequency of the first frequency signal, where the first frequency signal may be a low-frequency signal.

In this embodiment, a part between the second connection portion A and the second end T of the antenna resonance arm 109 may be used as an antenna radiator to send or receive a second frequency signal. Impedance matching may be adjusted by changing the capacitance of the variable capacitor 106, so as to adjust a resonance frequency of the second frequency signal, where the second frequency signal may be a high-frequency signal.

Optionally, a distance between the second connection portion A and the first connection portion B is less than one eighth of a wavelength of a low-frequency resonance frequency.

Therefore, in this embodiment of the present invention, a high-frequency and low-frequency resonance environment may be formed using the distributed inductor formed between the first connection portion B and the second connection portion A on the metal frame, and by adjusting a capacitance of a variable capacitor connected in series with the distributed inductor, so as to simultaneously generate or receive a high-frequency signal and a low-frequency signal. The resonance frequency of the high-frequency signal and/or the resonance frequency of the low-frequency signal may be adjusted by changing the capacitance of the variable capacitor 106.

Figure 2:
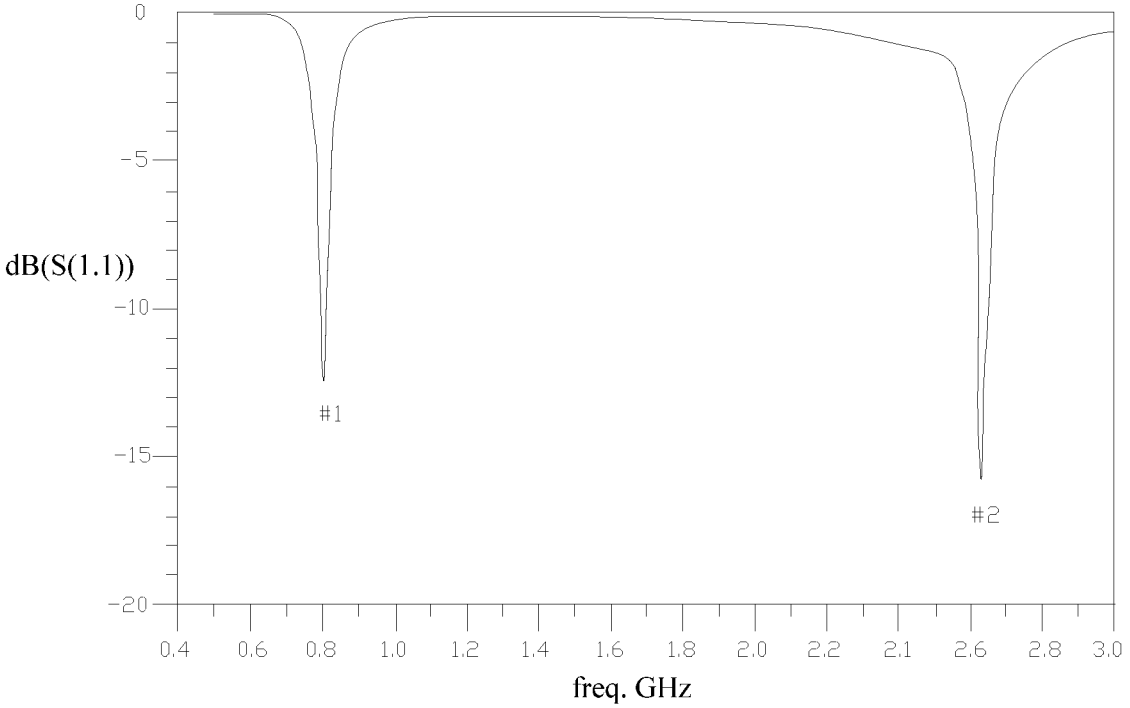
FIG. 2 is a frequency response diagram of a first embodiment of an electronic device according to the present disclosure.

For details, reference may be made to FIG. 2. FIG. 2 is a frequency response diagram of the first embodiment of the electronic device according to the present disclosure. As shown in FIG. 2, by adjusting in advance the distance between the second connection portion A and the first connection portion B in design, the distributed inductor is formed between the second connection portion A and the first connection portion B. A distributed inductance may be adjusted by adjusting the distance between the second connection portion A and the first connection portion B, so as to meet a boundary condition of the low-frequency resonance frequency. For example, a part between the first connection portion B and the second connection portion A of the antenna resonance arm 109 of this embodiment of the present invention can generate a low frequency #1 (in this embodiment, the capacitance of the variable capacitor 106 may be adjusted to 0.7 pF to be applied to Long Term Evolution (LTE) B20) shown in FIG. 2. In addition, a part between the second connection portion A and the second end T of the antenna resonance arm 109 can simultaneously generate a high frequency #2 (which may be applied to LTE B7 in this embodiment) shown in FIG. 2.

Embodiment 2

Figure 3:
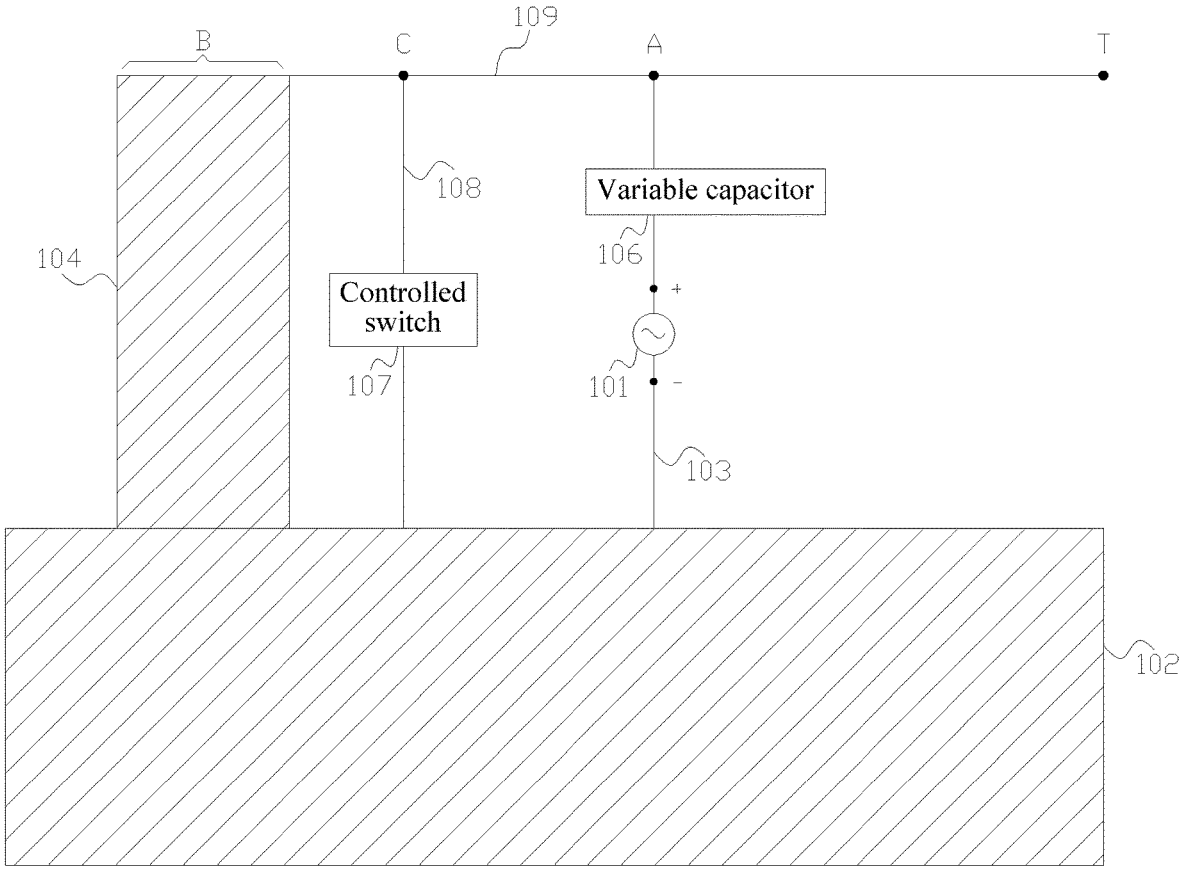
FIG. 3 is a schematic structural diagram of a second embodiment of an electronic device according to the present disclosure.

Referring to FIG. 3, FIG. 3 is a schematic structural diagram of a second embodiment of an electronic device according to the present disclosure. As shown in FIG. 3, this embodiment of the present disclosure provides an electronic device, where the electronic device is provided with a metal frame, the electronic device further includes an antenna feeding point +, an antenna ground 102, a feeding branch 103, a grounding branch 104, an antenna resonance arm 109, a variable capacitor 106, a control circuit, and a short grounding branch 108, the antenna resonance arm 109 is a part of the metal frame after segmentation, the antenna feeding point + is disposed on the feeding branch 103, a first connection portion B, a second connection portion A, and a third connection portion C are disposed on the antenna resonance arm 109, the first connection portion B is disposed on a first end of the antenna resonance arm 109, the second connection portion A is disposed between the first end and a second end T of the antenna resonance arm 109, the third connection portion C is between the first connection portion B and the second connection portion A, the feeding branch 103 is disposed between the second connection portion A and the antenna ground 102, the grounding branch 104 is disposed between the first connection portion B and the antenna ground 102, the variable capacitor 106 is disposed on the feeding branch 103, the variable capacitor 106 is disposed between the antenna feeding point + and the second connection portion A, the short grounding branch 108 is disposed between the third connection portion C and the antenna ground 102, a controlled switch 107 is disposed on the short grounding branch 108, the control circuit is configured to adjust a capacitance of the variable capacitor 106, and the control circuit is further configured to control the controlled switch 107 to be switched off or switched on.

The controlled switch 107 may be, for example, a single pole double throw (SPDT) switch or a single pole single throw (SPST) switch.

In this embodiment, when the controlled switch 107 is switched off, this embodiment is the same as the first embodiment. A low-frequency signal may be sent or received between the first connection portion B and the second connection portion A on the antenna resonance arm 109, and impedance matching may be adjusted by changing the capacitance of the variable capacitor 106, so as to adjust a low-frequency resonance frequency. In addition, a high-frequency signal may be sent or received between the second connection portion A and the second end T of the antenna resonance arm 109. Impedance matching of the antenna may be adjusted by changing the capacitance of the variable capacitor 106, so as to adjust a high-frequency resonance frequency.

When the controlled switch 107 is switched on, the short grounding branch 108 is conductive. Therefore, a down ground current arrives at the antenna ground 102 directly through the third connection portion C and the short grounding branch 108 on which the controlled switch 107 is located. In this case, a part between the third connection portion C and the second end T of the antenna resonance arm 109 may send or receive the high-frequency signal. In addition, a resonance frequency of the high-frequency signal may be adjusted by adjusting the capacitance of the variable capacitor 106. In this embodiment, the part between the third connection portion C and the second end T of the antenna resonance arm 109 is used as an antenna radiator to send or receive the high-frequency signal, which is different from that, in the first embodiment, a part between the second connection portion A and the second end T sends or receives a high-frequency signal. Therefore, the high-frequency signal in this embodiment has a different frequency from that of the high-frequency signal generated in the first embodiment, and may be, for example, a high-frequency signal applied to LTE B3.

Figure 4:
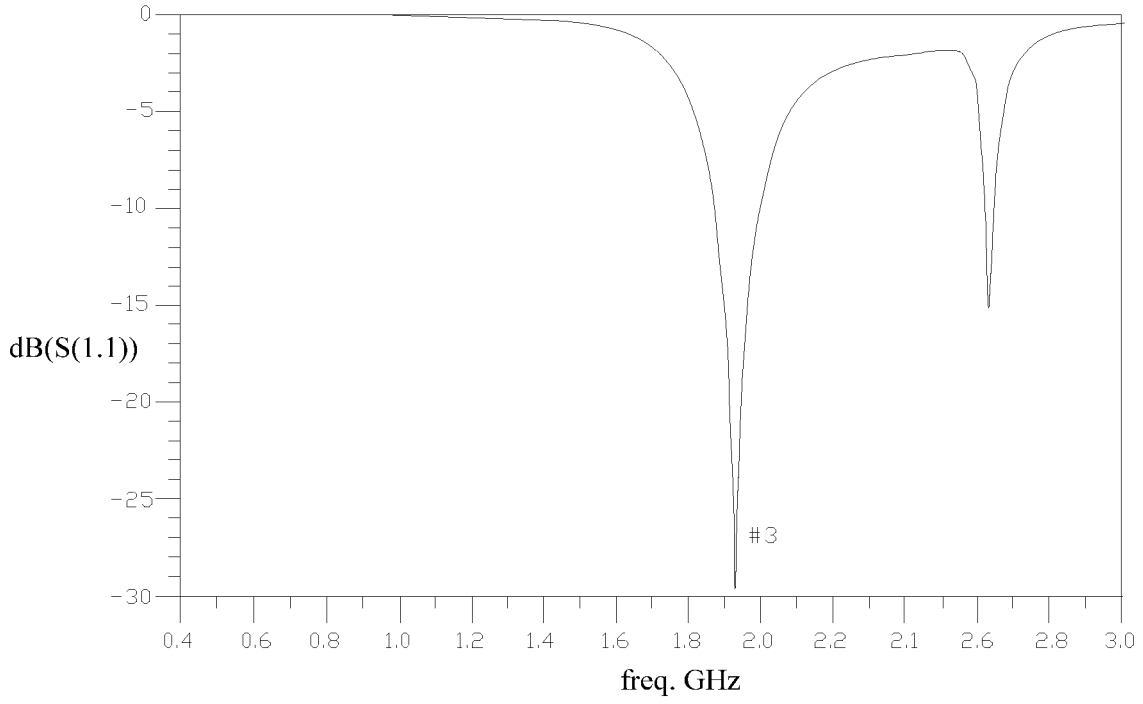
FIG. 4 is a frequency response diagram of a second embodiment of an electronic device according to the present disclosure.

For details, reference may be made to FIG. 4. FIG. 4 is a frequency response diagram of the second embodiment of the electronic device according to the present disclosure. When the controlled switch 107 is switched on, for the high-frequency signal, inductivity needs to be increased to reach best resonance matching. Therefore, when the electronic device of this embodiment of the present disclosure is produced, a best high-frequency response may be reached by adjusting a distance between the third connection portion C and the second end T, and by increasing the inductivity. Specifically, when the electronic device is produced, a high frequency #3 (applied to LTE B3 in this specification) and LTE B7 (specifically, is a frequency band on the right of the high frequency #3) may be generated by adjusting the distance between the third connection portion C and the second end T to a proper position (whose specific value depends on an actual condition).

Figure 5:
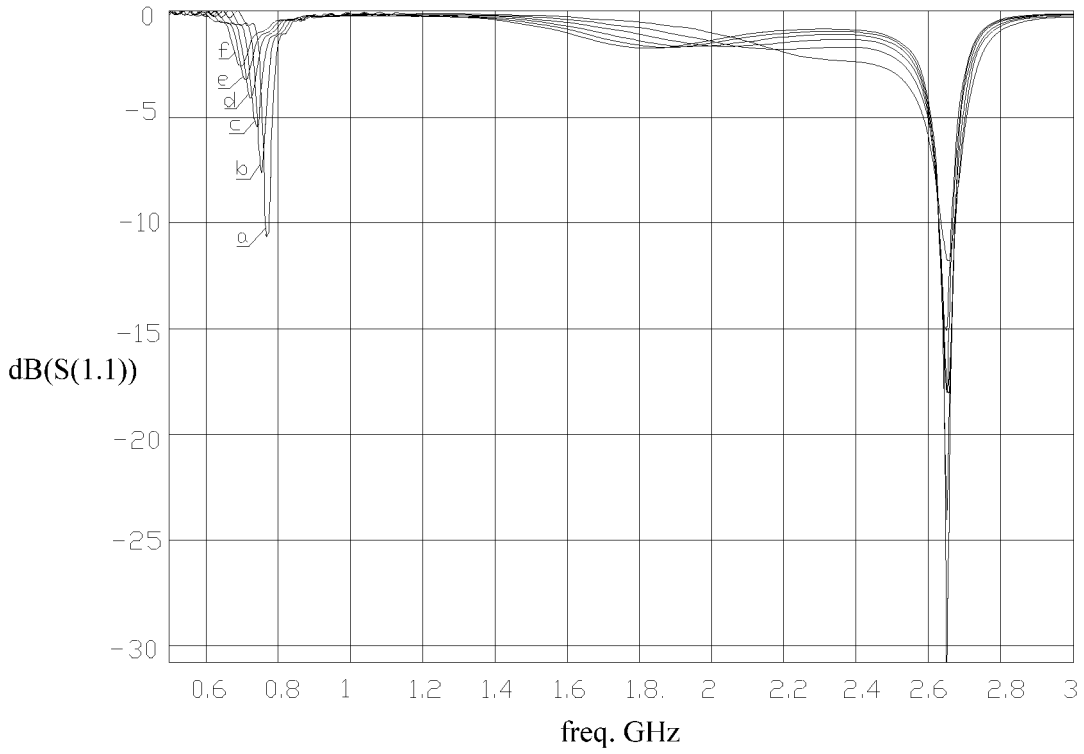
FIG. 5 is a frequency response curve graph corresponding to adjustment of high and low frequencies of a variable capacitor when a controlled switch is in a switched-off state.
Figure 6:
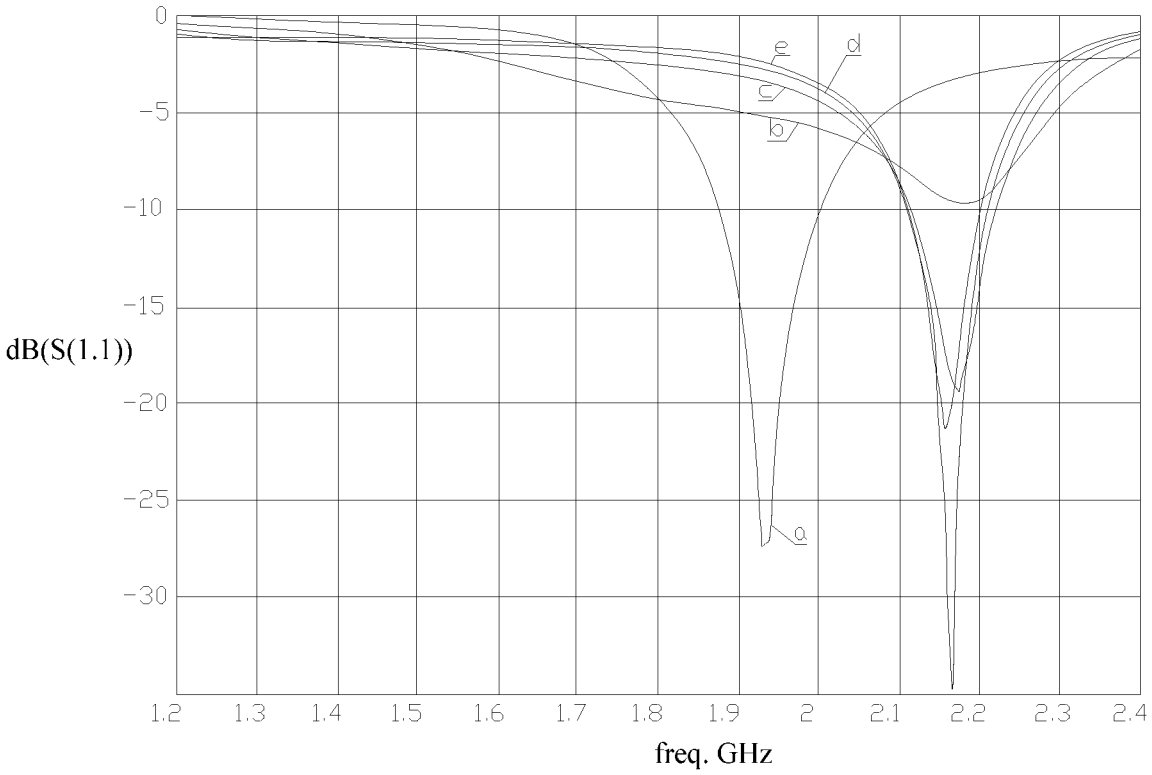
FIG. 6 is a frequency response curve graph corresponding to adjustment of a high frequency of a variable capacitor when a controlled switch is in a switched-on state.

FIG. 5 and FIG. 6 below show frequency response curve graphs obtained by adjusting the capacitance of the variable capacitor 106 when the controlled switch 107 is in a switched-off or switched-on state.

Figure 20:
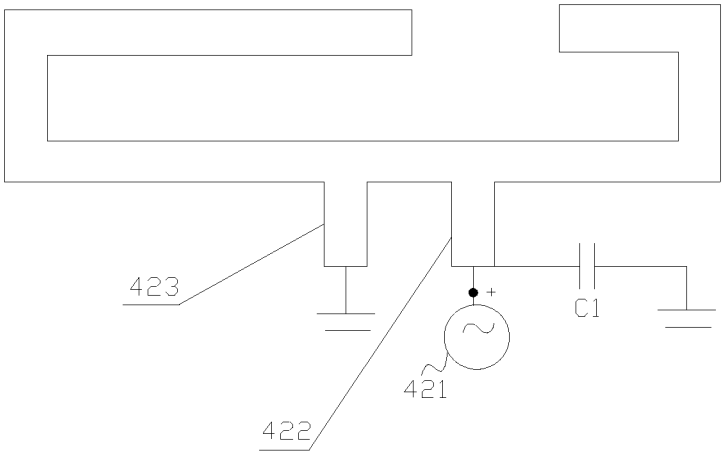
FIG. 20 is another schematic structural diagram of an inverted F antenna according to the present disclosure.

FIG. 5 is a frequency response curve graph corresponding to adjustment of high and low frequencies of the variable capacitor 106 when a controlled switch 107 is in a switched-off state. As shown in FIG. 20, a curve a is a frequency response curve when the capacitance of the variable capacitor 106 is 0.5 pF. A capacitance corresponding to a curve b is 0.6 pF. A capacitance corresponding to a curve c is 0.7 pF. A capacitance corresponding to a curve d is 0.8 pF. A capacitance corresponding to a curve e is 0.9 pF. A capacitance corresponding to a curve f is 1 pF. It can be known according to FIG. 5 that, when the controlled switch 107 is in a switched-off state, the low-frequency resonance frequency is fine-tuned according to a change of the capacitance of the variable capacitor 106, and a high-frequency resonance frequency changes little with the capacitance of the variable capacitor 106.

FIG. 6 is a frequency response curve graph corresponding to adjustment of a high frequency of a variable capacitor 106 when a controlled switch 107 is in a switched-on state. A curve a is a frequency response curve when the capacitance of the variable capacitor 106 is 0.7 pF. A capacitance corresponding to a curve b is 1.2 pF. A capacitance corresponding to a curve c is 1.7 pF. A capacitance corresponding to a curve d is 2.2 pF. A capacitance corresponding to a curve e is 2.7 pF. It can be known according to FIG. 6 that, when the controlled switch 107 is in a switched-on state, the high-frequency resonance frequency is adjusted according to a change of the capacitance of the variable capacitor 106.

Therefore, in this embodiment of the present disclosure, a high-frequency and low-frequency resonance environment may be generated using a distributed inductor formed between the first connection portion B and the second connection portion A on the metal frame, and by disposing a variable capacitor connected in series with the distributed inductor, so as to simultaneously send or receive a high-frequency signal and a low-frequency signal. Resonance frequencies of the high-frequency signal and the low-frequency signal are adjusted by changing the capacitance of the variable capacitor 106.

In addition, in this embodiment of the present disclosure the short grounding branch 108 is further disposed. When the controlled switch 107 is controlled to be switched on to make the down ground current pass through the short grounding branch 108, a length of the antenna radiator may be changed. That is, the part between the third connection portion C and the second end T of the antenna resonance arm 109 is used as the antenna radiator, so as to send or receive a high-frequency signal that is different from that in the first embodiment.

Optionally, the controlled switch 107 may be replaced with a filter. The filter used in this embodiment of the present disclosure may be a filter having a low-frequency-band high-impedance characteristic and a high-frequency-band low-impedance characteristic.

The filter may be a high-pass filter, or a band-stop filter for a low frequency band. A characteristic requirement for the filter is presenting a high impedance at a low frequency band and presenting a low impedance at a high frequency band. Therefore, when the antenna resonance arm 109 works at a low frequency band, a radio frequency current on the third connection portion C is barred by a high impedance of the filter, and can pass to the ground only through an inductor branch on which the inductor is located or the grounding branch 104. When the antenna resonance arm 109 works at a high frequency band, the filter presents a low impedance, and is even equivalent to being directly connected to the ground, and therefore, the down ground current is shunt mainly from the filter and then is connected to the ground, so as to ensure a same effect as that obtained by disposing the controlled switch 107.

Figure 7:
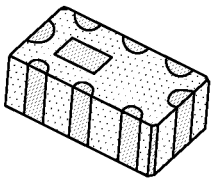
FIG. 7 is a schematic diagram of an implementation manner of a filter according to the present disclosure.
Figure 8:
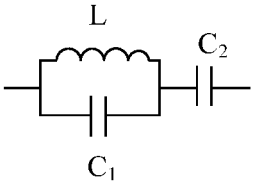
FIG. 8 is a schematic diagram of another implementation manner of a filter according to the present disclosure.
Figure 9:
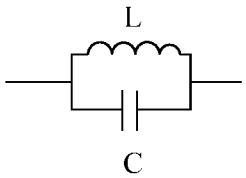
FIG. 9 is a schematic diagram of another implementation manner of a filter according to the present disclosure.
Figure 10:
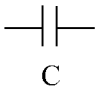
FIG. 10 is a schematic diagram of another implementation manner of a filter according to the present disclosure.
Figure 11:
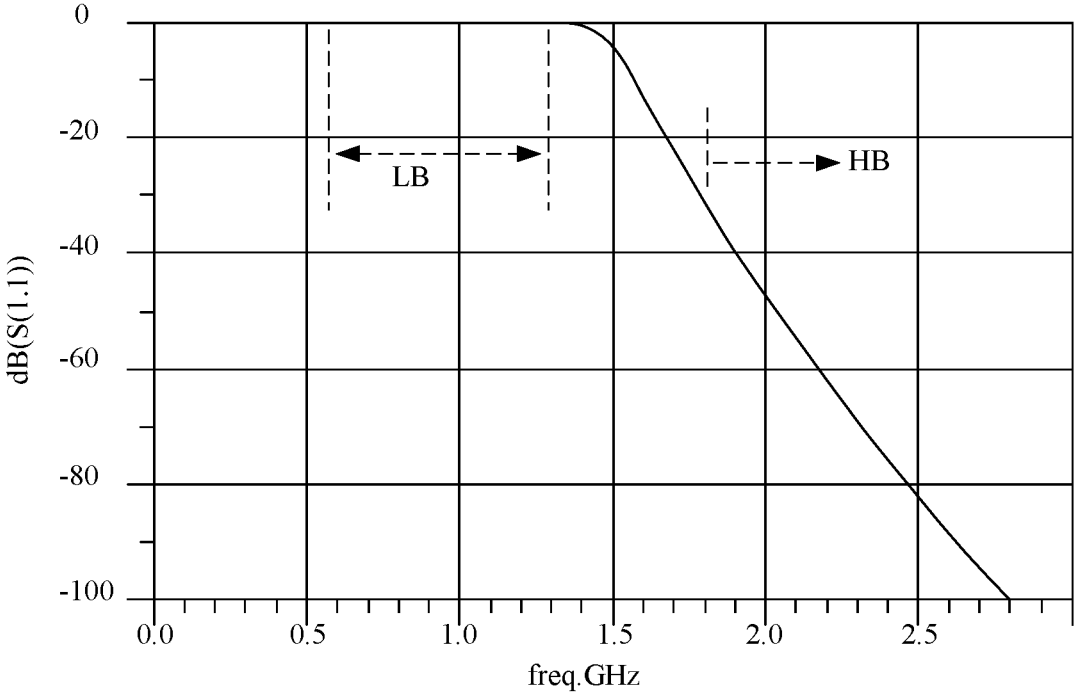
FIG. 11 is a schematic diagram of a high-pass characteristic of a filter according to the present disclosure.
Figure 12:
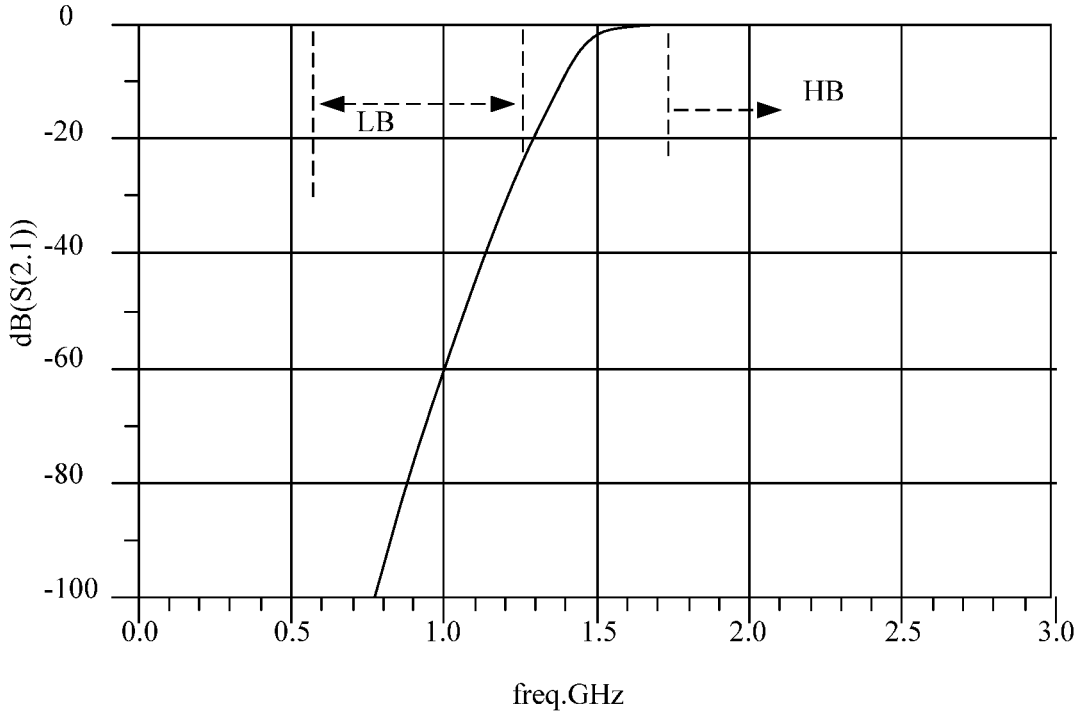
FIG. 12 is a schematic diagram of another high-pass characteristic of a filter according to the present disclosure.
Figure 13:
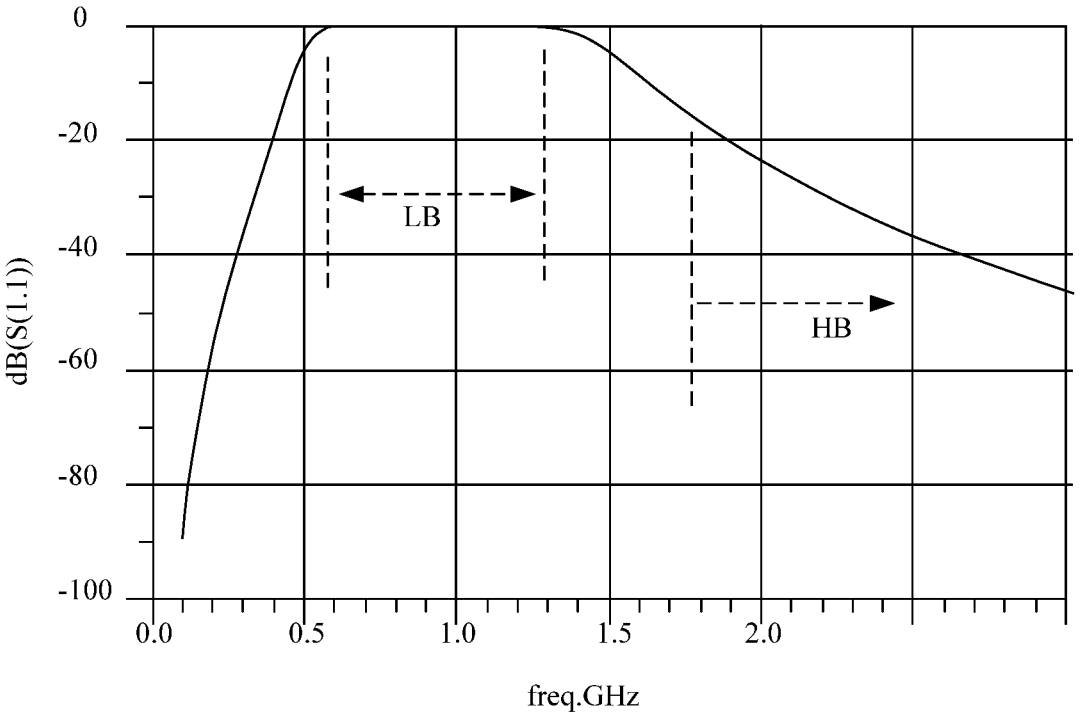
FIG. 13 is a schematic diagram of a low-frequency-band impedance characteristic of a filter according to the present disclosure.
Figure 14:
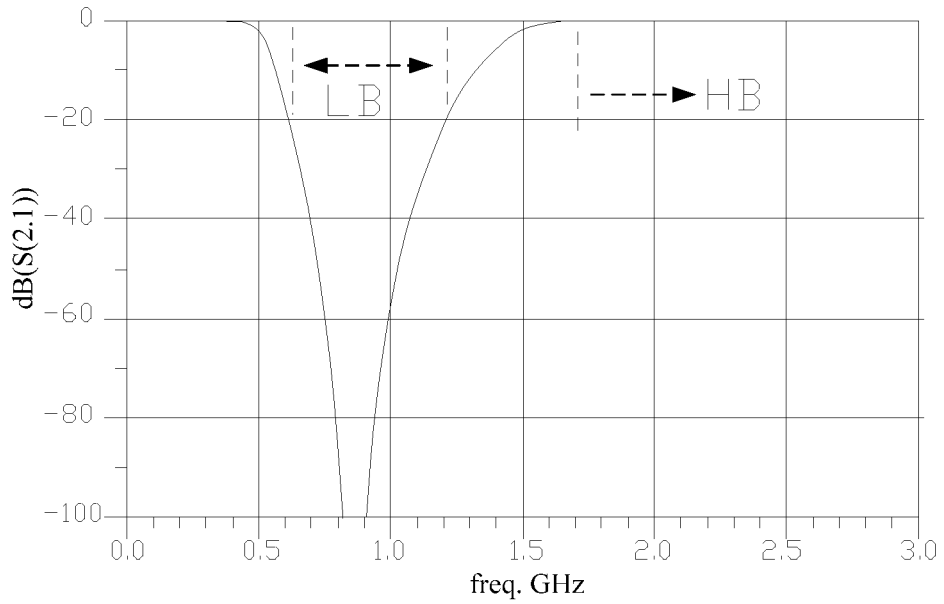
FIG. 14 is a schematic diagram of another low-frequency-band impedance characteristic of a filter according to the present disclosure.

An implementation manner of the filter may be an integrated component shown in FIG. 7, or may be an LC network established by an inductor and a capacitor shown in FIG. 8 and FIG. 9, or even may be one single capacitor shown in FIG. 10, as long as the low-frequency-band high-impedance characteristic and the high-frequency-band low-impedance characteristic described above can be implemented. For specific characteristics of the filter, reference may be made to a high-pass characteristic shown in FIG. 11 and FIG. 12, or reference may be made to a low-frequency-band impedance characteristic shown in FIG. 13 and FIG. 14.

Embodiment 3

Figure 15:
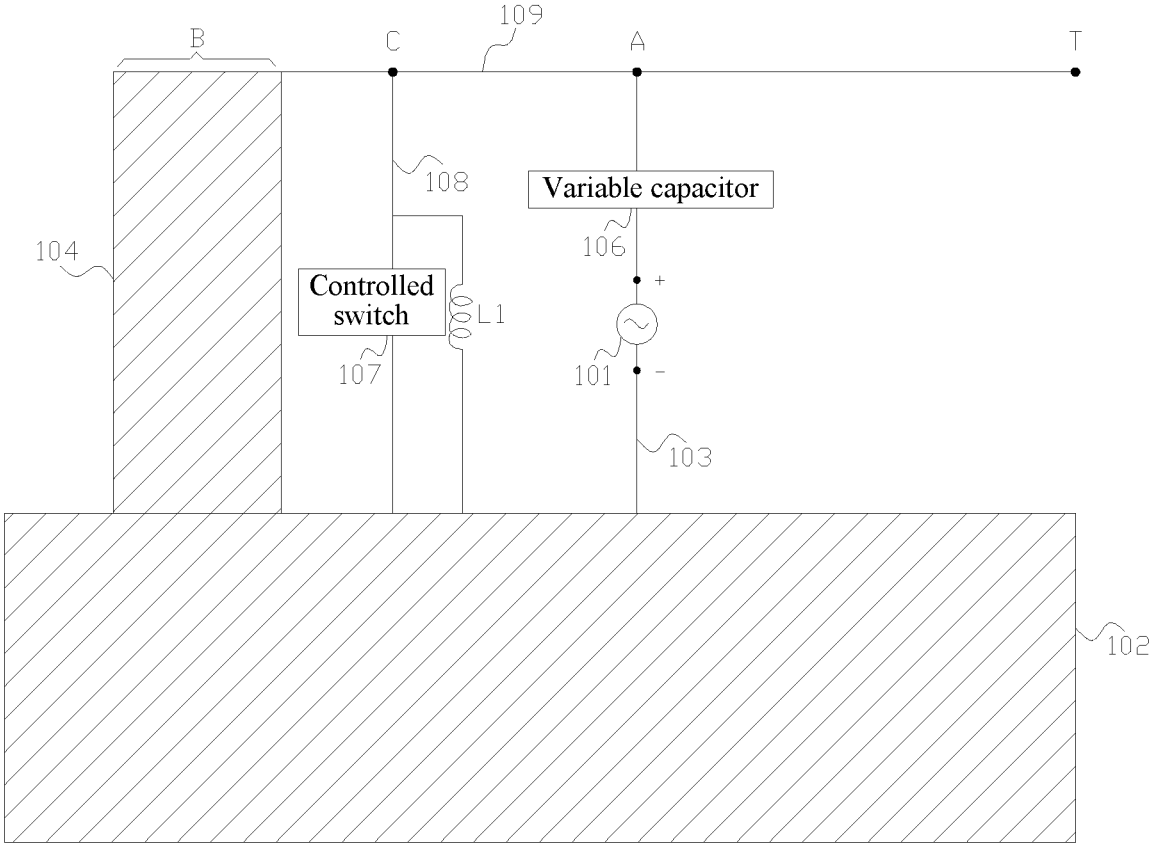
FIG. 15 is a schematic structural diagram of a third embodiment of an electronic device according to the present disclosure.

Referring to FIG. 15, FIG. 15 is a schematic structural diagram of a third embodiment of an electronic device according to the present disclosure. As shown in FIG. 15, a difference between this embodiment and the second embodiment lies in that an inductor L1 is further disposed based on the second embodiment, and the inductor L1 is arranged in parallel to a controlled switch 107. Specifically, when the controlled switch 107 is switched on, the inductor L1 may shunt down a ground current of the short grounding branch 108, so as to avoid that all down ground current flows through the controlled switch 107 to cause loss of the controlled switch 107. In addition, when the controlled switch 107 is switched off, the inductor L1 may also shunt down a ground current of the grounding branch 104. Therefore, when the controlled switch 107 is switched off, an inductance of the inductor L1 is adjusted so as to implement adjustment on a low-frequency resonance frequency at the same time.

Figure 16:
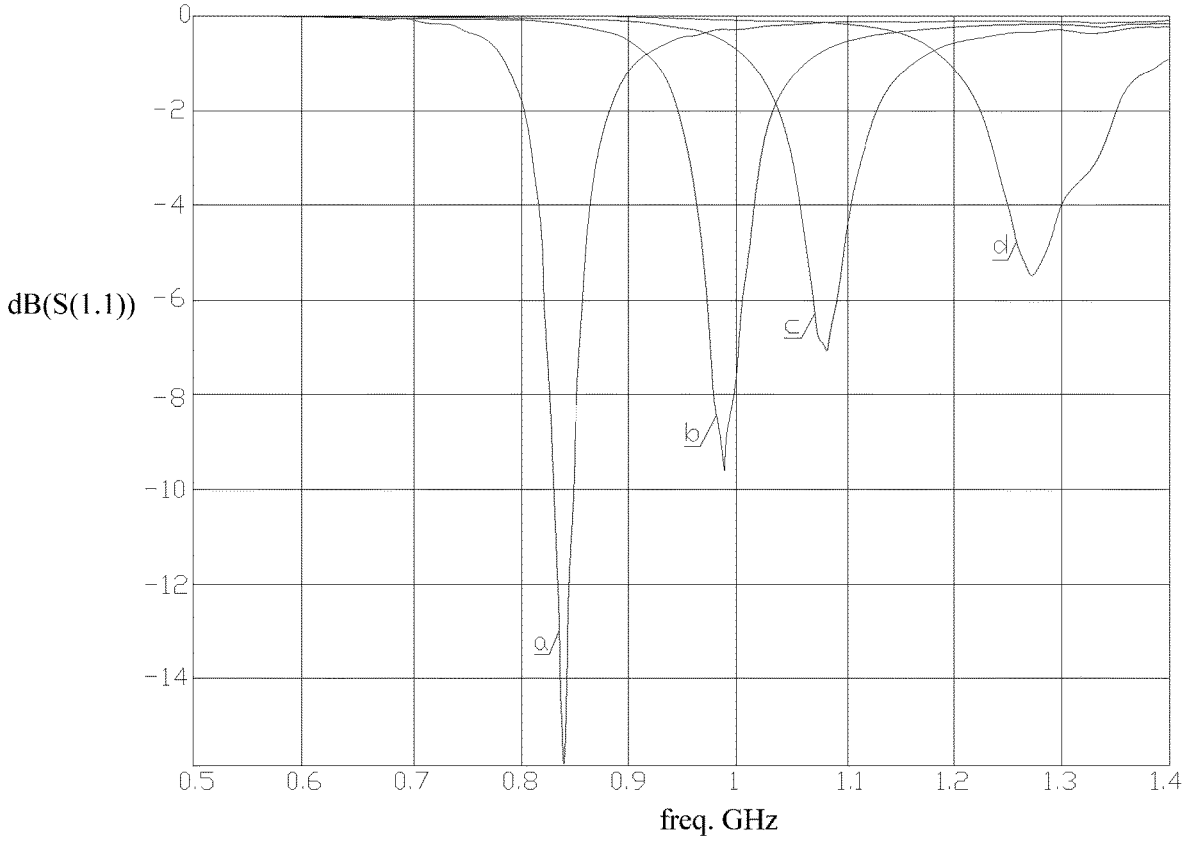
FIG. 16 is a frequency response curve graph of a low-frequency resonance frequency when a controlled switch being switched off is connected in parallel to inductors having different inductances.

For details, reference may be made to FIG. 16. FIG. 16 is a frequency response curve graph of a low-frequency resonance frequency when a controlled switch 107 being switched off is connected in parallel to inductors L1 having different inductances. As shown in FIG. 16, a curve a is a frequency response curve when no inductor L1 is disposed and the capacitance of the variable capacitor 106 is 0.7 pF. A curve b is a frequency response curve when an inductor L1 is disposed, an inductance is 5 nH, and a corresponding capacitance is 0.7 pF. A curve c is a frequency response curve when an inductor L1 is disposed, an inductance is 12 nH, and a corresponding capacitance is 0.7 pF. A curve d is a frequency response curve when an inductor L1 is disposed, an inductance is 22 nH, and a corresponding capacitance is 0.7 pF. It can be known from FIG. 16 that, different inductances are selected so that the low-frequency resonance frequency may be offset, so as to implement the adjustment on the low-frequency resonance frequency.

Further, after multiple times of experiments and simulations, the inventor concludes design of inverted F antennas of several architectures, so that the low-frequency resonance frequency may fall in a high-impedance region. By combining the design of the inverted F antennas of the several architectures with the electronic device disclosed in this embodiment of the present disclosure, and in cooperation with the variable capacitor 106 connected in series, impedance matching of the low-frequency resonance frequency can be implemented. Detailed descriptions of the several inverted F antennas and a corresponding electronic device are separately given below.

Figure 17:
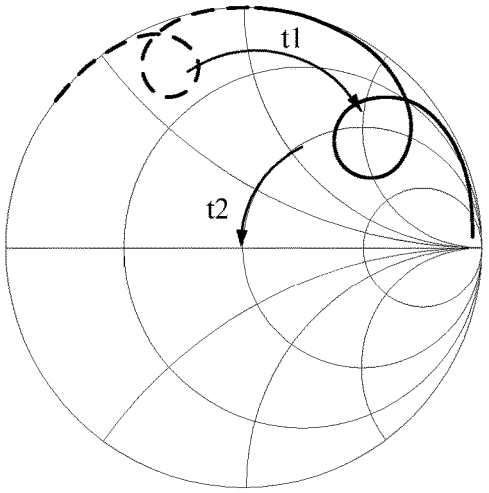
FIG. 17 is a Smith chart of an antenna according to an embodiment of the present disclosure.

First, for details, reference may be made to FIG. 17. FIG. 17 is a Smith chart of an antenna according to an embodiment of the present disclosure. As shown in FIG. 17, an impedance curve of the Smith chart may move along an arrow t1 to a high-impedance region (that is, a right region on the Smith chart) using the design of the several inverted F antennas described in the following embodiment. In addition, the capacitance of the variable capacitor 106 connected in series with a feeding branch 103 is adjusted, so that the impedance curve may move along an arrow t2 to an impedance matching region (that is, a middle horizontal line between an upper part and a lower part on the Smith chart), so as to achieve an objective of the impedance matching.

Figure 18:
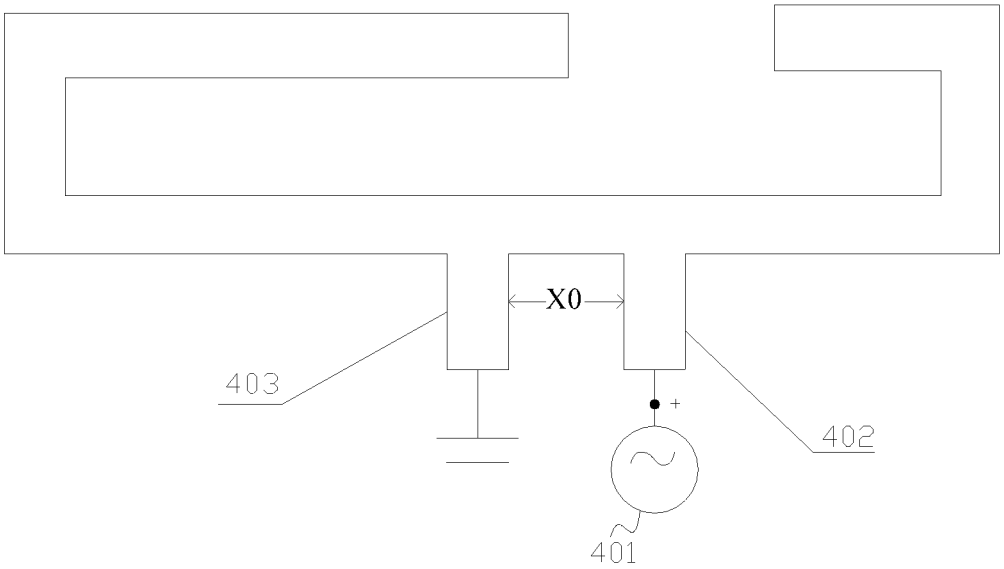
FIG. 18 is a schematic structural diagram of an existing inverted F antenna.
Figure 19:
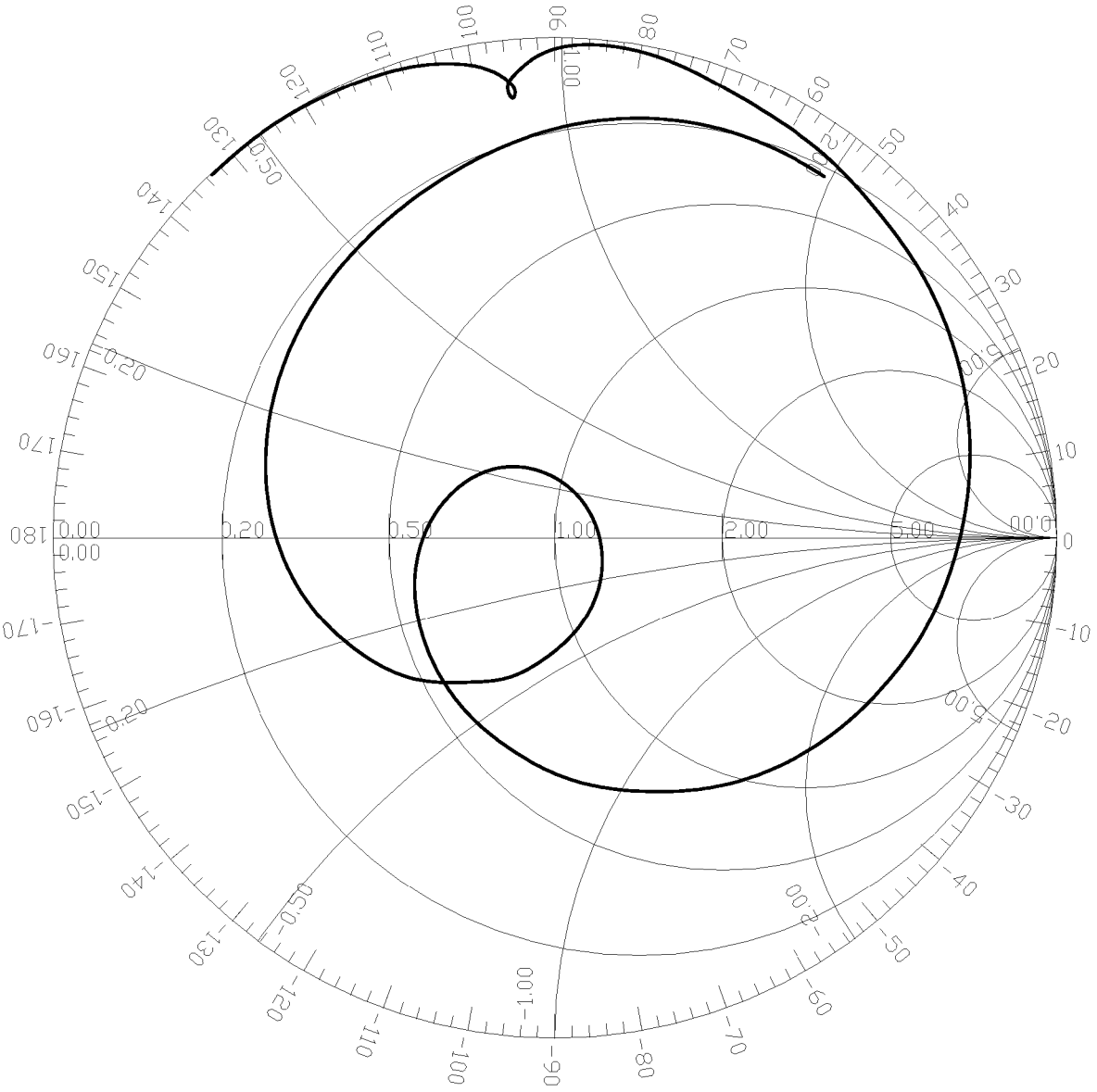
FIG. 19 is a Smith chart of an existing inverted F antenna whose frequency ranges from 0.5 GHz to 3 GHz.

Several architectures of the inverted F antennas are concluded below when the low-frequency resonance frequency falls in the high-impedance region, and the architectures are applied to this embodiment of the present disclosure. For example, referring to FIG. 18 and FIG. 19 first, FIG. 18 is a schematic structural diagram of an inverted F antenna, and FIG. 19 is a Smith chart of an inverted F antenna whose frequency ranges from 0.5 GHz to 3 GHz. In FIG. 18, a distance X0 between a feeding point 402 and a grounding point 403 is 10 centimeters (cm). Referring to the Smith chart shown in FIG. 19, it can be known that an impedance curve does not fall in the high-impedance region.

In Embodiments 4 to 6 below, several methods for enabling the low-frequency resonance frequency to fall in the high-impedance region are separately listed. An effect of impedance matching can be achieved in combination with the foregoing technical means of adjusting the variable capacitor 106.

Embodiment 4

In this embodiment, based on Embodiment 2, an electronic device further includes a capacitor C1 connected in parallel to an antenna feeding point +.

Figure 21:
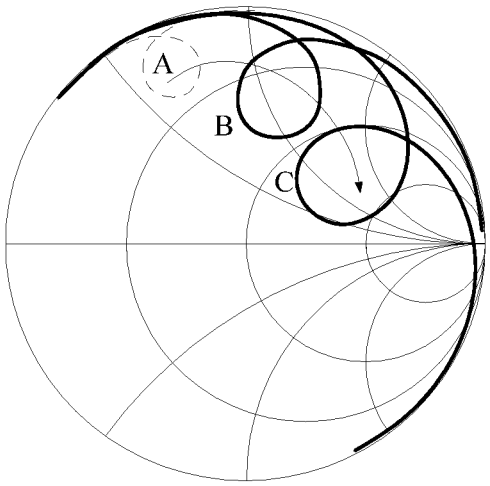
FIG. 21 is a Smith chart of an inverted F antenna according to the present disclosure.

For details, reference is made to FIG. 20 and FIG. 21. FIG. 20 is another schematic structural diagram of an inverted F antenna according to the present disclosure, and FIG. 21 is a Smith chart of an inverted F antenna according to the present disclosure. In FIG. 20, based on Embodiment 2, the capacitor C1 is disposed. The capacitor C1 is arranged in parallel to the feeding point +. A low-frequency resonance frequency may fall in a high-impedance region using the capacitor C1. As shown in FIG. 21, in the Smith chart, an impedance curve A is a case in which no capacitor C1 is disposed. An impedance curve C is a case in which a capacitor C1 is disposed and a corresponding capacitance of C1 is 5 pF. A curve B is a case in which a capacitor C1 is disposed and a corresponding capacitance of C1 is 5 pF. Therefore, relative to the curve A for which no capacitor C1 is disposed, it is easier for the impedance curve B and the impedance curve C to fall in the high-impedance region.

Figure 22:
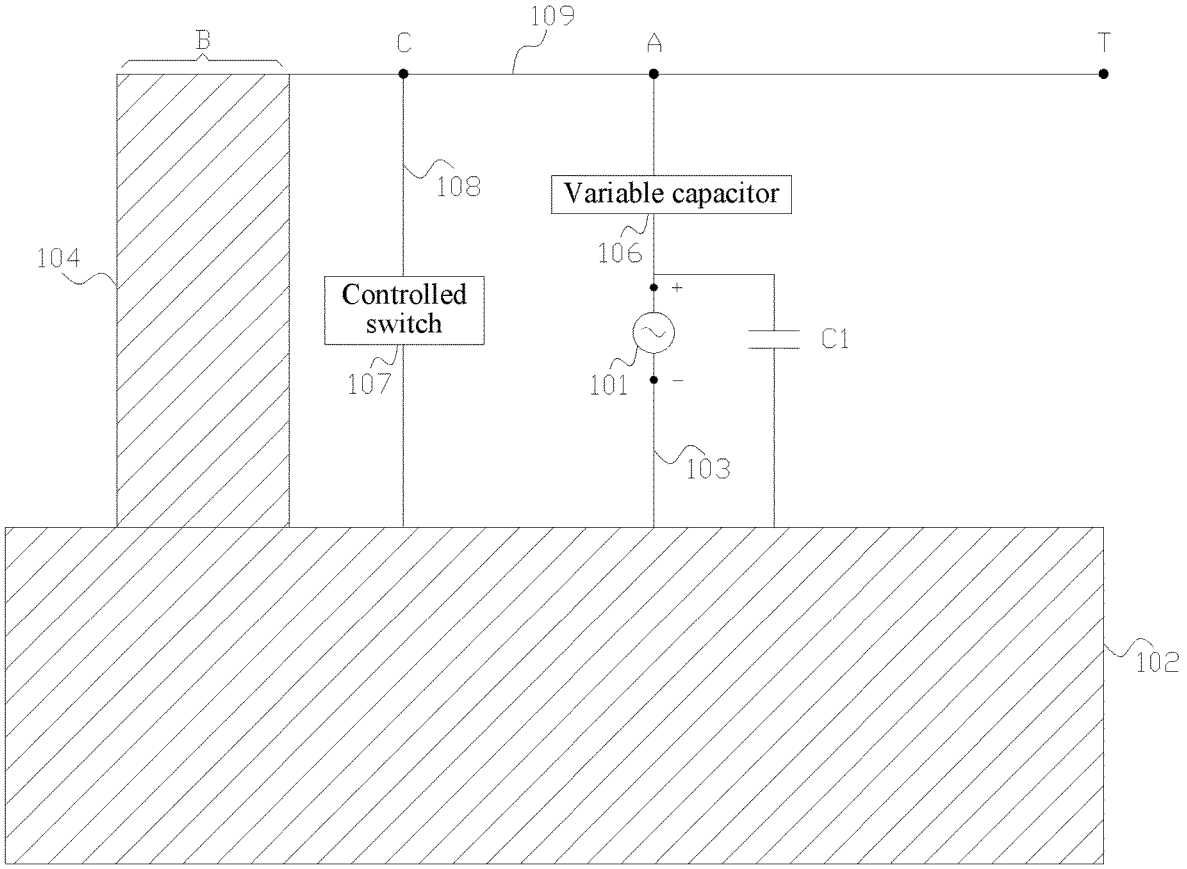
FIG. 22 is a schematic structural diagram of a fourth embodiment of an electronic device according to the present disclosure.

Referring to FIG. 22, FIG. 22 is a schematic structural diagram of a fourth embodiment of an electronic device according to the present invention. In the fourth embodiment of the electronic device according to the present disclosure, design shown in FIG. 20 is further applied to the antenna of this embodiment of the present disclosure. The capacitor C1 connected in parallel to the feeding point + (that is, the capacitor C1 is connected in parallel to a feeding source 101, and after parallel connection to the feeding source 101, one end of the capacitor C1 is connected to an antenna ground 102, and the other end is connected to a variable capacitor 106) is disposed, so that the low-frequency resonance frequency may fall in the high-impedance region. A capacitance of the variable capacitor 106 is adjusted, so that the low-frequency resonance frequency may fall in an impedance matching region.

Embodiment 5

In this embodiment, based on Embodiment 2, an electronic device further includes an inductor L2 connected in series with an antenna feeding point +.

Figure 23:
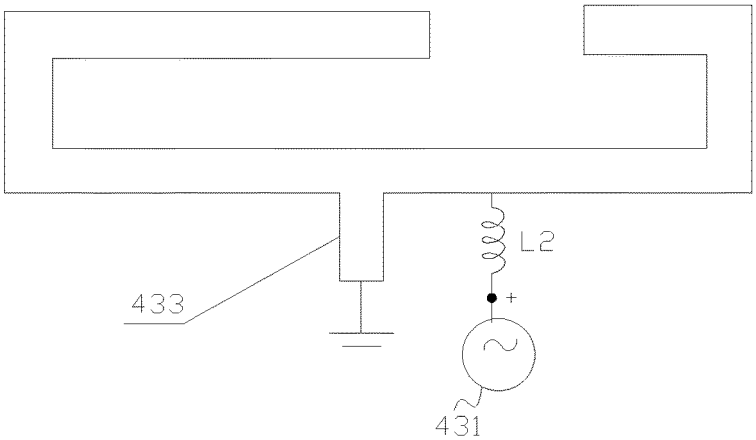
FIG. 23 is another schematic structural diagram of an inverted F antenna according to the present disclosure.
Figure 24:
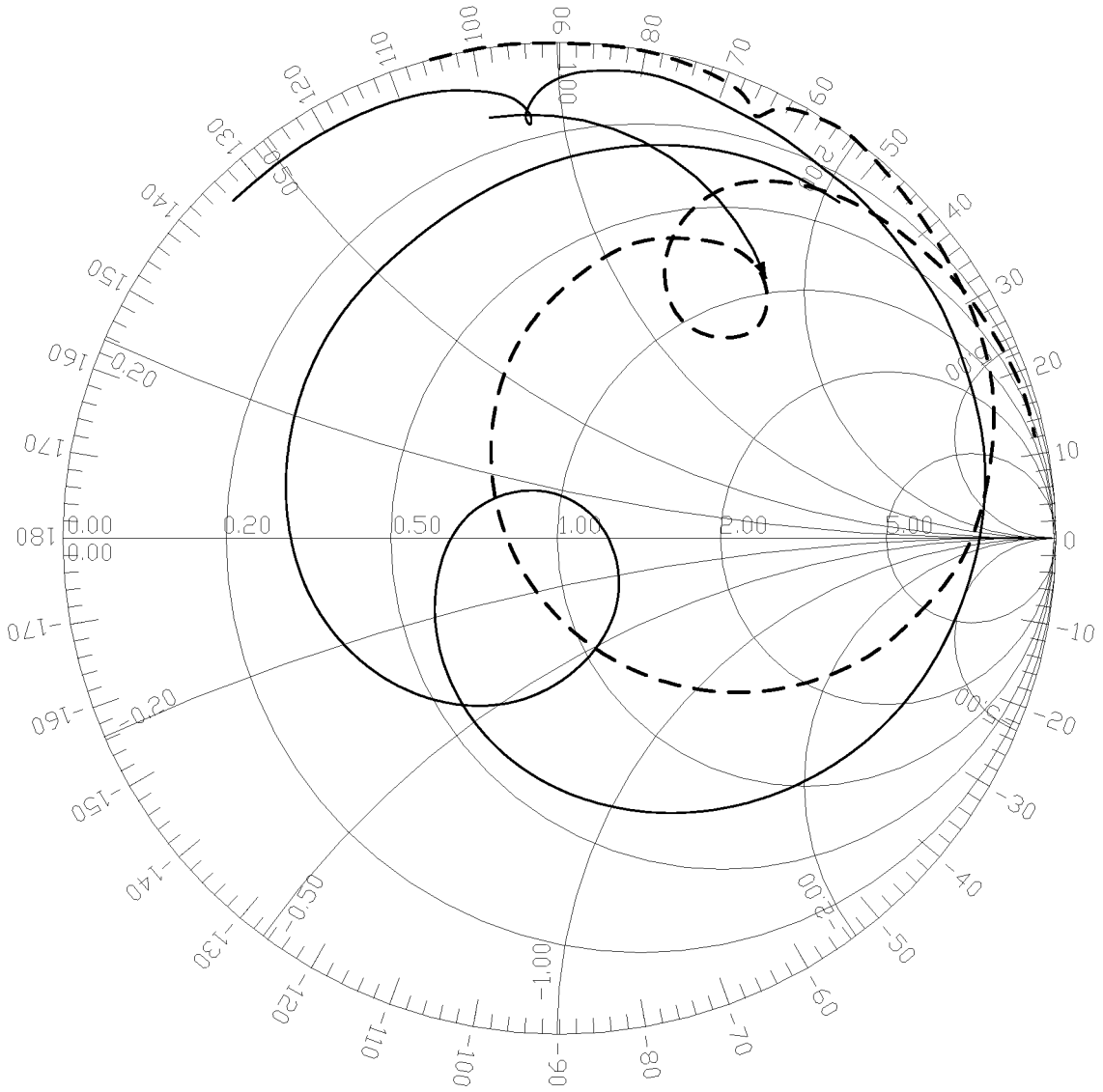
FIG. 24 is a Smith chart of an inverted F antenna according to the present disclosure.

For details, reference is made to FIG. 23 and FIG. 24. FIG. 23 is another schematic structural diagram of an inverted F antenna according to the present disclosure, and FIG. 24 is a Smith chart of an inverted F antenna according to the present disclosure. The inductor L2 connected in series with the feeding point is further disposed and impedance matching is adjusted using inductivity of the inductor L2, so that a low-frequency resonance frequency may fall in a high-impedance region.

Figure 25:
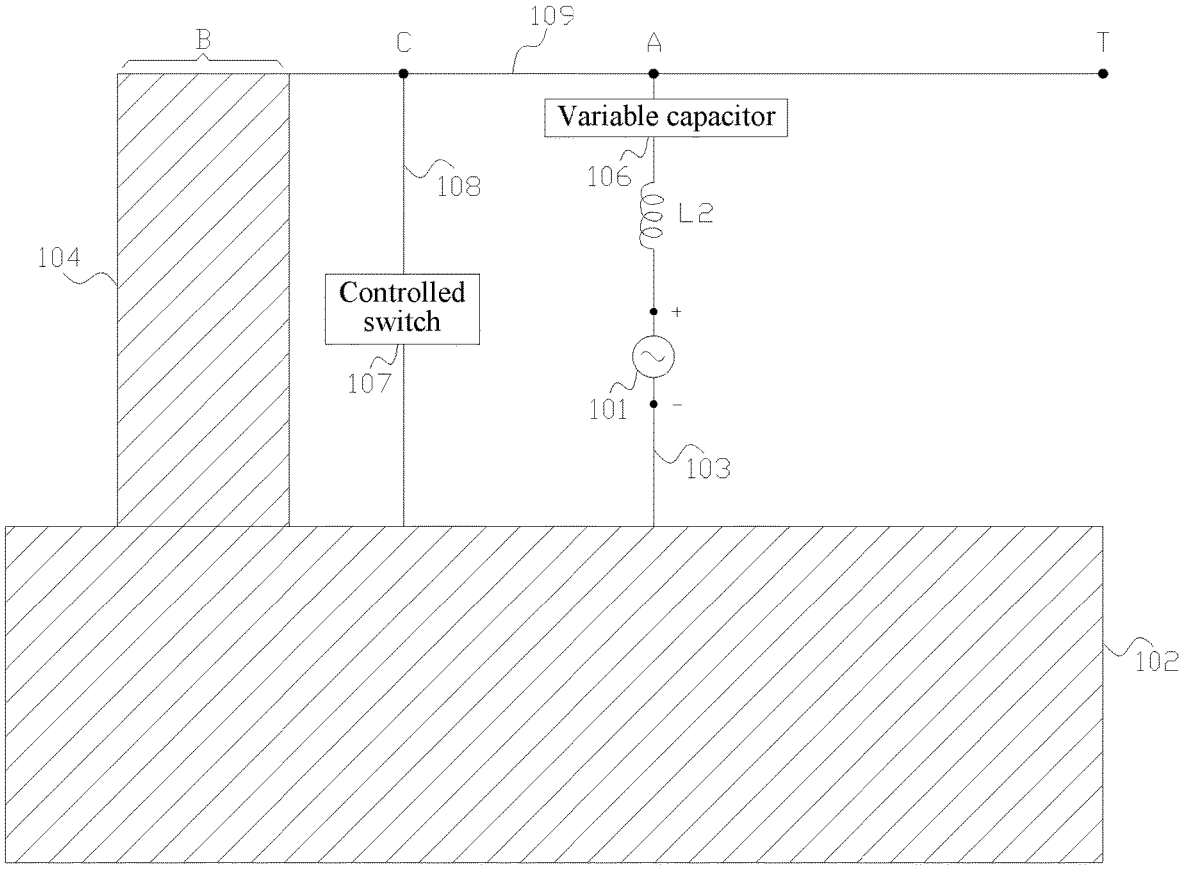
FIG. 25 is a schematic structural diagram of a fifth embodiment of an antenna according to the present disclosure.

Referring to FIG. 25, FIG. 25 is a schematic structural diagram of a fifth embodiment of an antenna according to the present disclosure. In the fifth embodiment of the antenna according to the present disclosure, the foregoing design is further applied to the antenna of the present disclosure. Specifically, as shown in FIG. 25, in the present disclosure, the inductor L2 is disposed between the feeding point + and the variable capacitor 106, so that the low-frequency resonance frequency may fall in the high-impedance region. A capacitance of the variable capacitor 106 is adjusted, so that the low-frequency resonance frequency may fall in an impedance matching region.

Embodiment 6

In this embodiment, based on Embodiment 2, an antenna resonance arm 109 further has a fourth connection portion D disposed between a first connection portion B and a second connection portion A. An electronic device further includes a capacitor C2 disposed between the fourth connection portion D and an antenna ground 102. The fourth connection portion D is connected to the antenna ground 102 using the capacitor C2.

Figure 26:
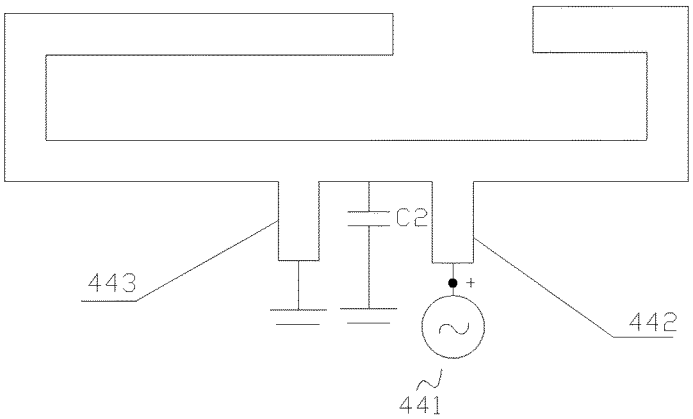
FIG. 26 is another schematic structural diagram of an inverted F antenna according to the present disclosure.
Figure 27:
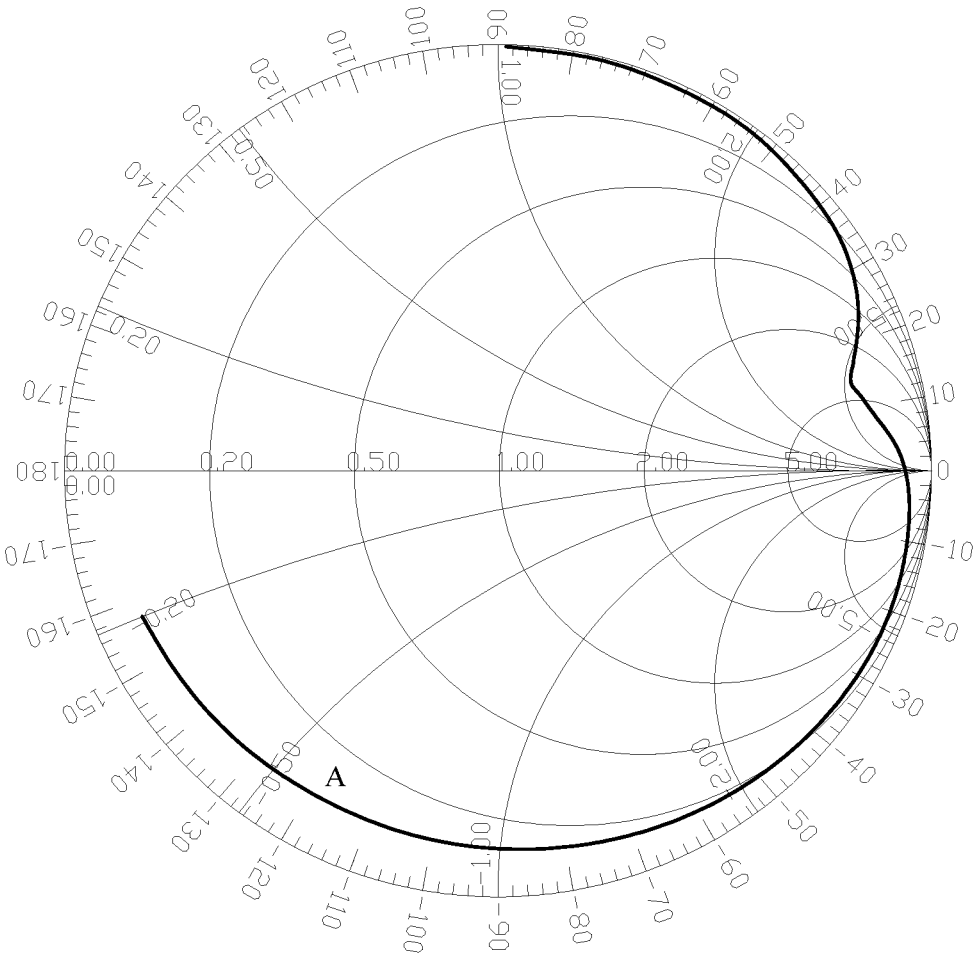
FIG. 27 is a Smith chart of an inverted F antenna according to the present disclosure whose frequency ranges from 0.5 GigaHertz (GHz) to 1.2 GHz.
Figure 28:
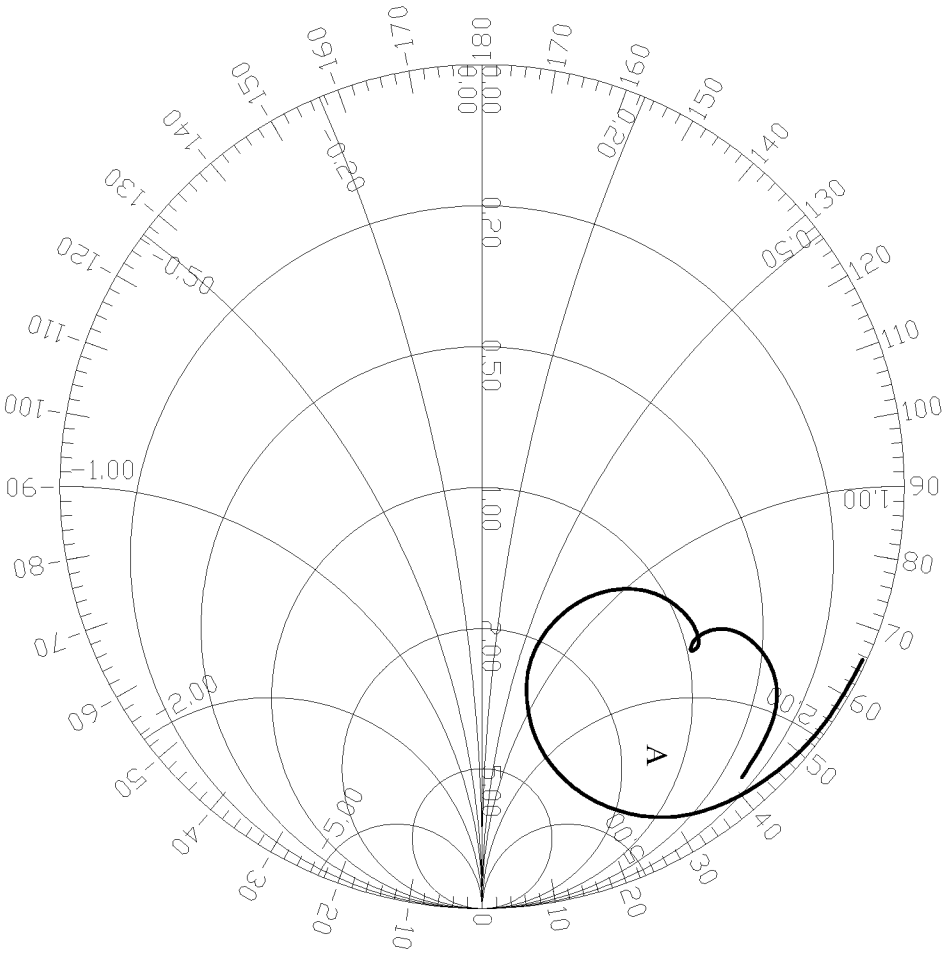
FIG. 28 is a Smith chart of an inverted F antenna according to the present disclosure whose frequency ranges from 1.5 GHz to 3.0 GHz.

For details, reference is made to FIG. 26 to FIG. 28. FIG. 26 is another schematic structural diagram of an inverted F antenna according to the present invention, FIG. 27 is a Smith chart of an inverted F antenna according to the present invention whose frequency ranges from 0.5 GHz to 1.2 GHz, and FIG. 28 is a Smith chart of an inverted F antenna according to the present disclosure whose frequency ranges from 1.5 GHz to 3.0 GHz. It can be known from FIG. 26 that, in this embodiment, a middle down ground leg is disposed between a grounding leg 443 and a feeding leg 442, and the capacitor C2 is disposed on the middle down ground leg. Such design can make a low-frequency resonance frequency fall in the high-impedance region. For details, reference may be made to the Smith charts shown in FIG. 27 and FIG. 28. In FIG. 27 and FIG. 28, an impedance curve A is an impedance curve after the middle down ground leg is disposed.

Figure 29:
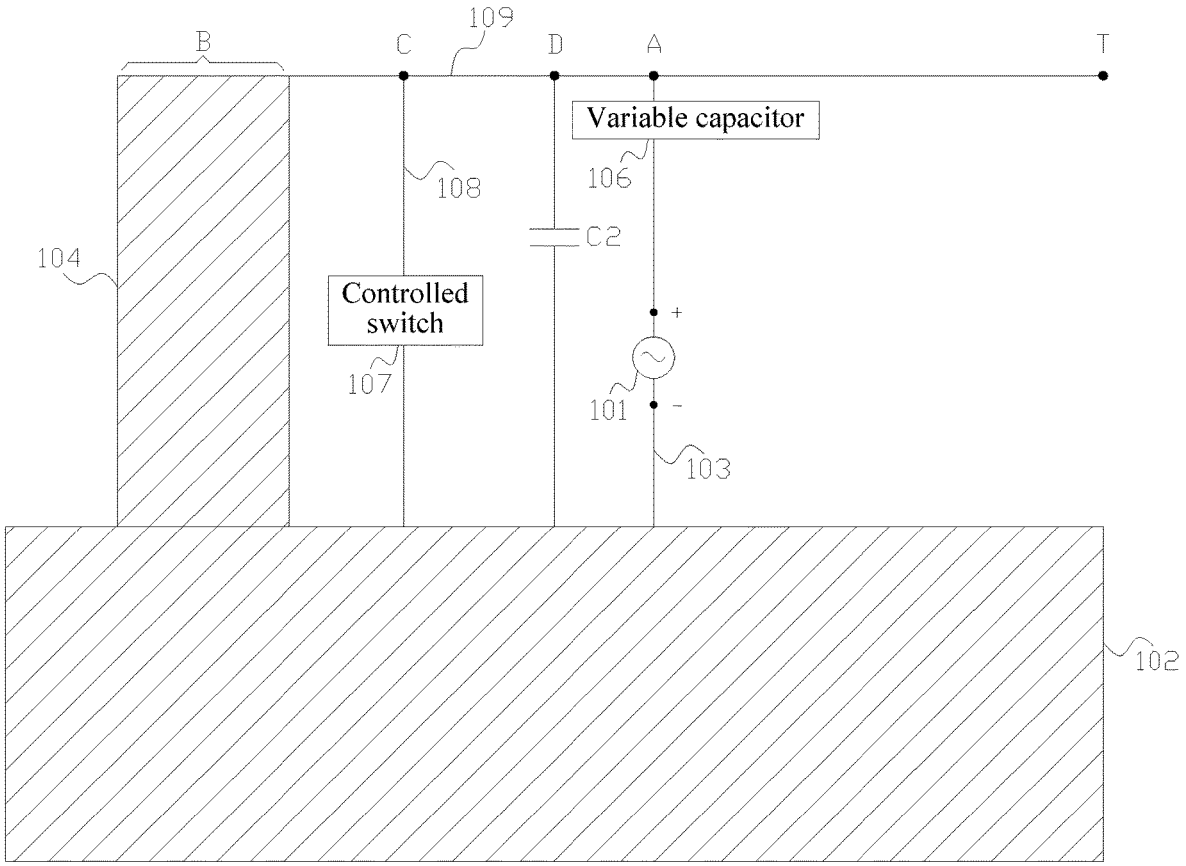
FIG. 29 is a schematic structural diagram of a fifth embodiment of an antenna according to the present disclosure.

Referring to FIG. 29, FIG. 29 is a schematic structural diagram of a fifth embodiment of an antenna according to the present disclosure. In this embodiment, the design shown in FIG. 26 is applied to the electronic device of this embodiment of the present disclosure. Specifically, as shown in FIG. 29, the fourth connection portion D is disposed between the second connection portion A and the first connection portion B, the capacitor C2 is disposed between the fourth connection portion D and the antenna ground 102, and the fourth connection portion D is connected to the antenna ground 102 using the capacitor C2, so that the low-frequency resonance frequency may fall in the high-impedance region. A capacitance of the variable capacitor 106 is adjusted, so that the low-frequency resonance frequency may fall in an impedance matching region.

Figure 30:
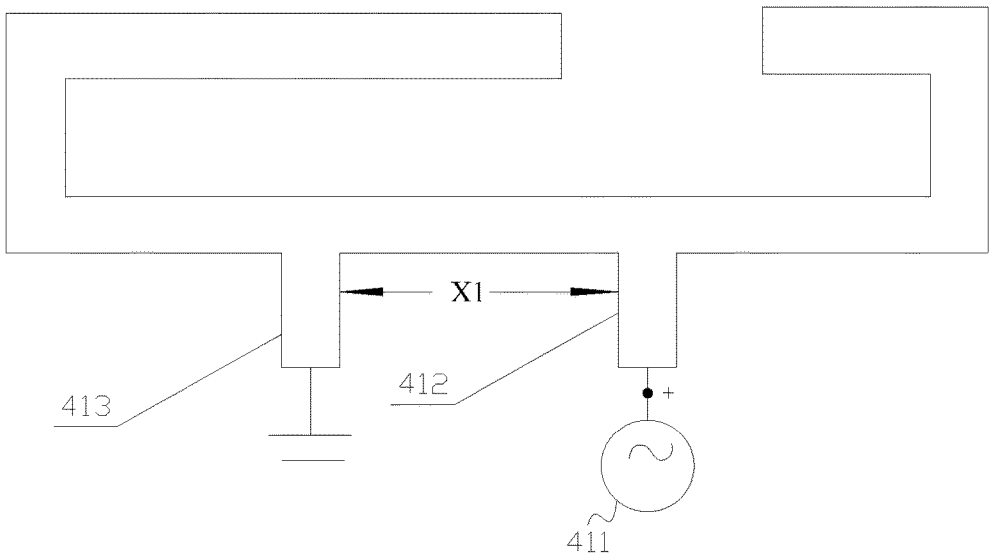
FIG. 30 is a schematic structural diagram of an embodiment of an inverted F antenna according to the present disclosure.
Figure 31:
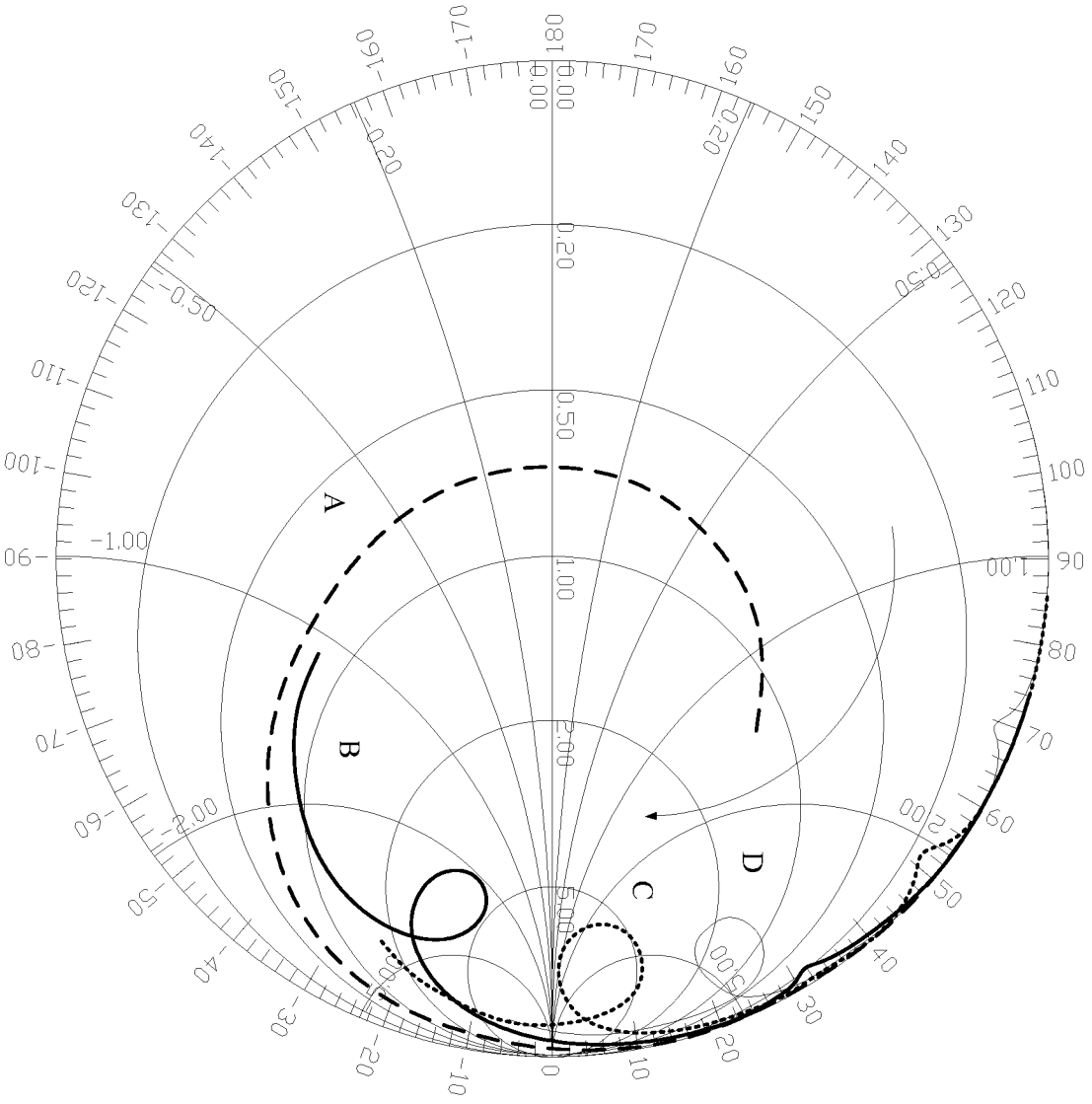
FIG. 31 is a Smith chart of an inverted F antenna according to the present disclosure.

In addition, an implementation manner in which no electronic element needs to be added to make the low-frequency resonance frequency fall in the high-impedance region is further disclosed herein. For details, reference is made to FIG. 30 and FIG. 31. FIG. 30 is a schematic structural diagram of an embodiment of an inverted F antenna according to the present disclosure, and FIG. 31 is a Smith chart of an inverted F antenna according to the present disclosure. In FIG. 30, for example, a predetermined distance X1 between a feeding point 412 and a grounding point 413 is changed, so that the low-frequency resonance frequency may fall in the high-impedance region. With reference to the implementation manner of the present disclosure, if the capacitance of the variable capacitor 106 is simultaneously adjusted, an effect of impedance matching may be achieved.

As shown in FIG. 31, X1=15 millimeters (mm) corresponds to an impedance curve D, X1=19 mm corresponds to an impedance curve C, X1=25 mm corresponds to an impedance curve B, and X1=36 mm corresponds to an impedance curve A. It can be known by comparison that, when X1=36 mm, the impedance curve A may fall in the high-impedance region, where X1=36 mm is a preferred implementation manner of the present invention.

Reference may be further made to FIG. 3. With reference to Embodiment 2, a distance between the second connection portion A and the first connection portion B may be adjusted, so that the distance between the second connection portion A and the first connection portion B is kept at X1=36 mm, and so that the low-frequency resonance frequency may fall in the high-impedance region. In addition, the variable capacitor 106 is adjusted, so that the low-frequency resonance frequency falls from the high-impedance region to the impedance matching region.

For a specific structure of the electronic device described in all embodiments of the present disclosure, reference may be made to FIG. 32 to FIG. 36 below.

Preferably, the electronic device may be of a size of 138 mm×69 mm×6.2 mm (length×width×height).

Figure 32:
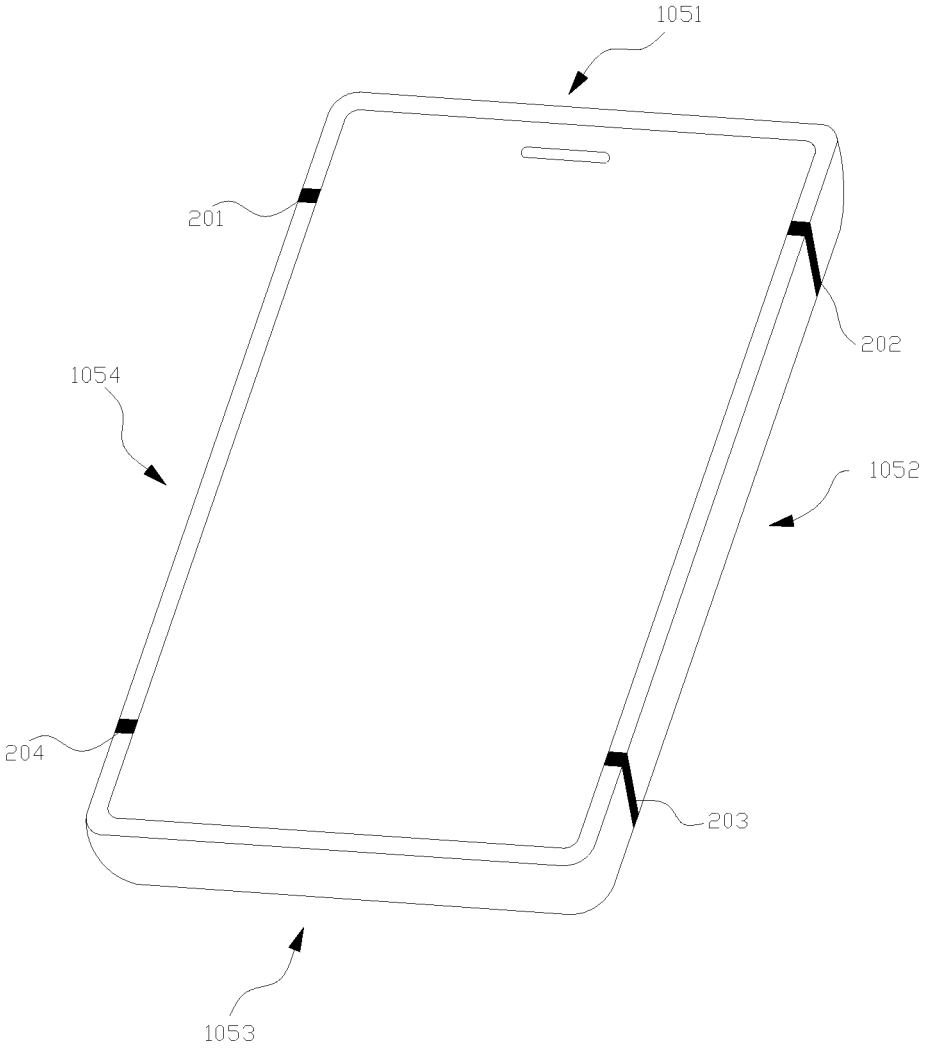
FIG. 32 is a side view of an electronic device according to an embodiment of the present disclosure.

Referring to FIG. 32, FIG. 32 is a side view of an electronic device according to an embodiment of the present disclosure. In the electronic device of this embodiment, the electronic device is cuboid, and a metal frame is ring-shaped and is disposed on four side walls of the electronic device. The metal frame is segmented into four parts by insulation media 201, 202, 203, and 204. Metal frame parts 1051, 1052, 1053, and 1054 on the side walls of the electronic device may all be used as the antenna resonance arm 109.

Figure 33:
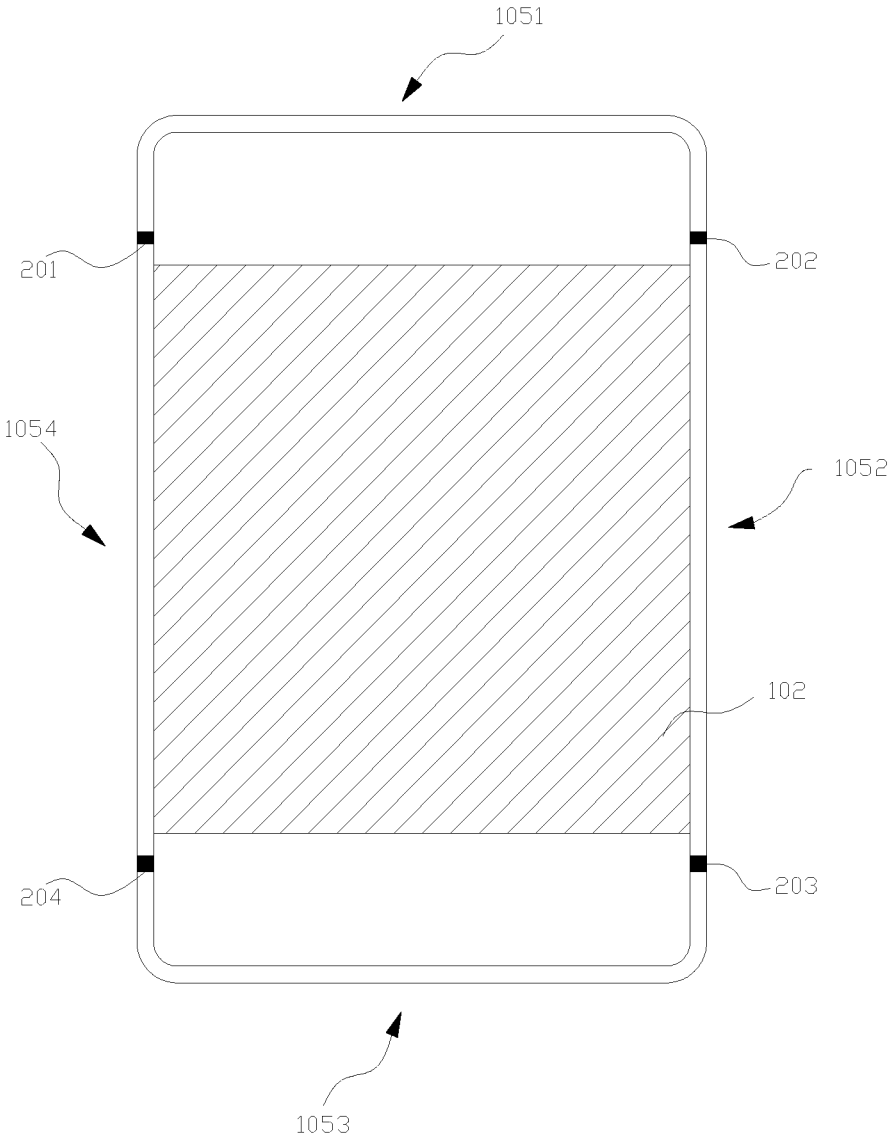
FIG. 33 is a cross-sectional view of an electronic device according to an embodiment of the present disclosure.

Referring to FIG. 33, FIG. 33 is a cross-sectional view of an electronic device according to an embodiment of the present disclosure. As shown in FIG. 33, an antenna ground 102 is disposed in the electronic device, and the antenna ground 102 may a ground of a circuit board of the electronic device. However, the present disclosure is not limited thereto. In an optional embodiment, the antenna ground 102 may be further a metal rack for supporting a screen, or a metal framework in a device.

Figure 34:
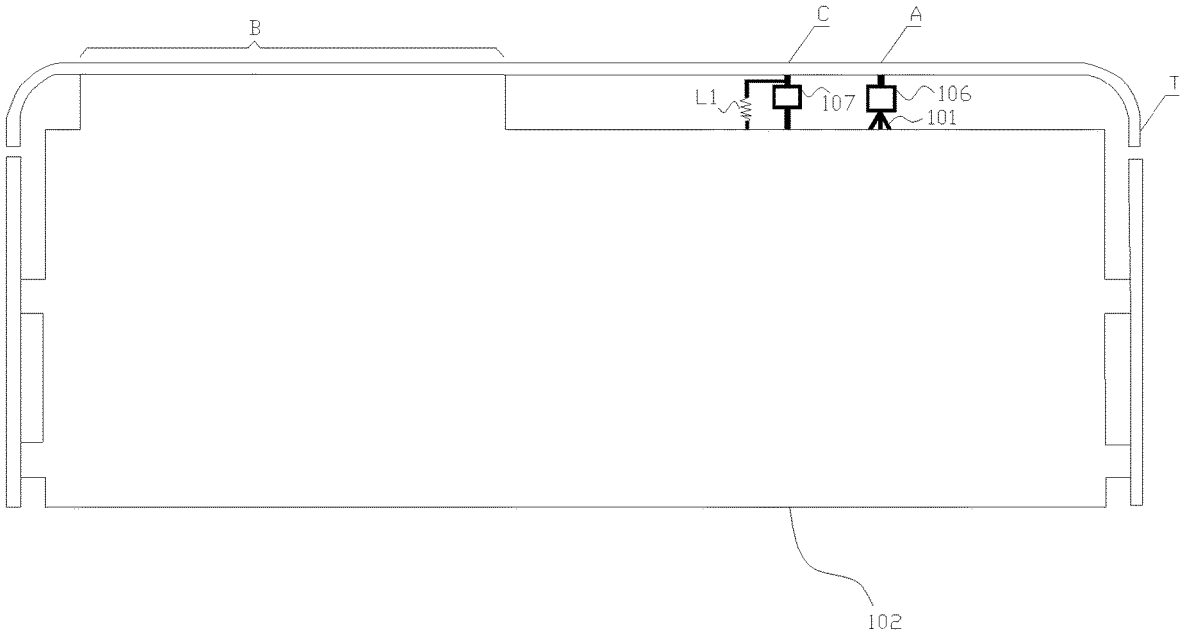
FIG. 34 is a sectional view of an electronic device according to an embodiment of the present disclosure.

In order to make the description more clearly, for details, reference is further made to FIG. 34, FIG. 34 is a sectional view of an electronic device according to an embodiment of the present disclosure. A part between a second end T of the metal frame and the first connection portion B is used as the antenna resonance arm.

Figure 35:
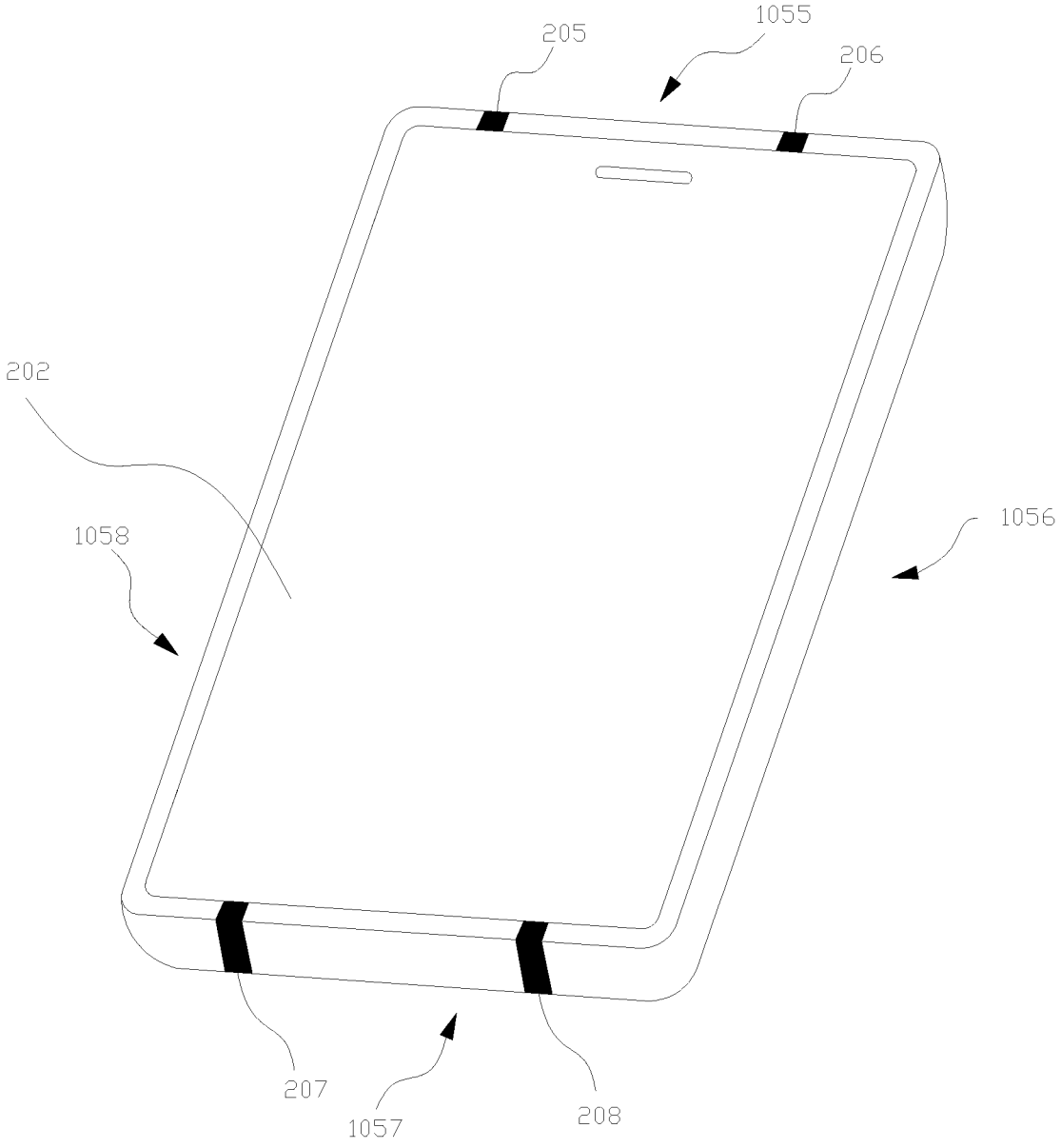
FIG. 35 is a side view of an electronic device according to another embodiment of the present disclosure.
Figure 36:
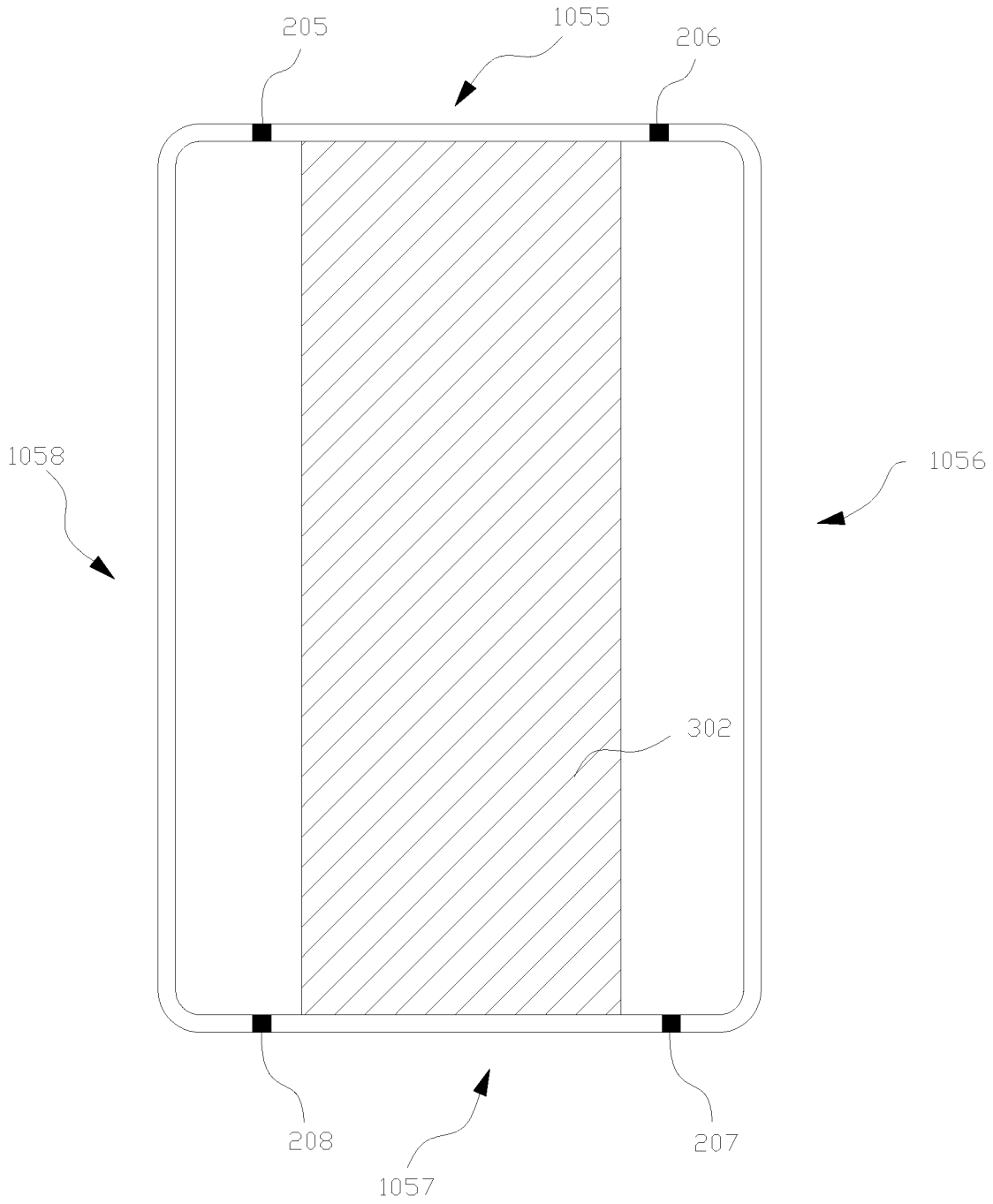
FIG. 36 is a cross-sectional view of an electronic device according to another embodiment of the present disclosure.

FIG. 35 and FIG. 36 show a specific structure of an electronic device according to another embodiment of the present disclosure. FIG. 35 is a side view of an electronic device according to another embodiment of the present invention, and FIG. 36 is a cross-sectional view of an electronic device according to another embodiment of the present disclosure. In this embodiment of the present disclosure, a metal frame is segmented into four parts by insulation media 205, 206, 207, and 208. Metal frame parts 1055, 1056, 1057, and 1058 may be used as the antenna resonance arm in this embodiment of the present invention.

The foregoing examples describe some selection manners of the antenna resonance arm in this embodiment of the present invention. A person skilled in the art may correspondingly select the metal frame according to actual situations without departing from the idea of the present disclosure, which is not limited in this embodiment of the present disclosure.

In addition, the metal frame of the electronic device of this embodiment of the present disclosure is not limited to being segmented into four parts. In an optional embodiment of the present disclosure, it only needs to ensure that the metal frame is segmented into at least two parts by an insulation medium. For example, the metal frame is segmented only using the insulation medium 201 and the insulation medium 202.

Figure 37:
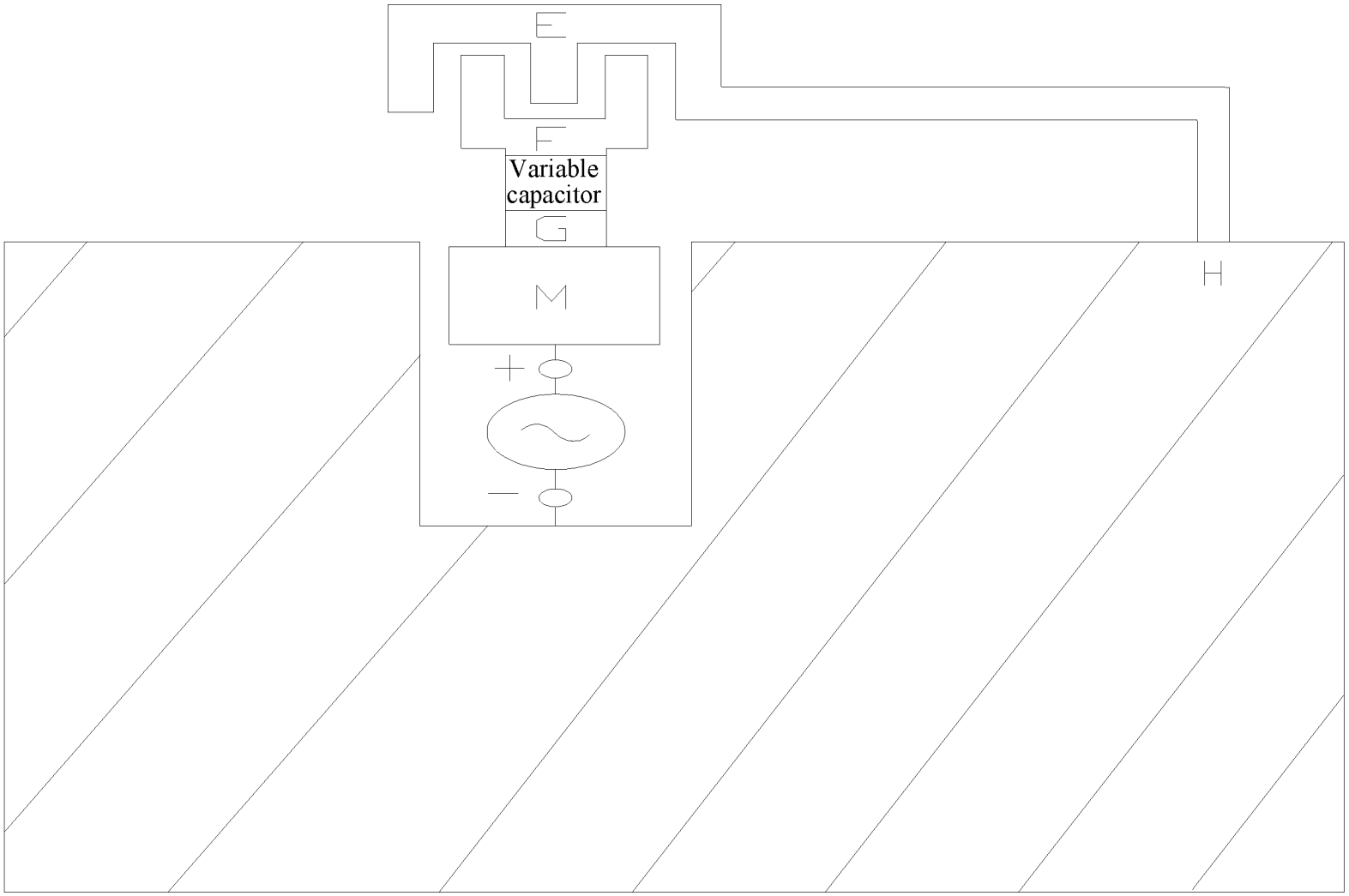
FIG. 37 is a schematic structural diagram of an arrangement manner of a variable capacitor according to the present disclosure.

Optionally, the foregoing variable capacitor 106 may be also disposed as shown in FIG. 37. FIG. 37 is a schematic structural diagram of an arrangement manner of a variable capacitor according to the present disclosure. A point H is an antenna grounding point. A point G is an antenna feeding point +. M is a matching circuit between a radio frequency circuit and an antenna. A point E and a point F separately are two parallel coupling electrodes that form a structure of a series-connected distributed capacitor. The structure of the distributed capacitor is selected in dependence on a value of the distributed capacitor, and may be in multiple forms. A variable capacitor is disposed between the point E and the point F. The series-connected distributed capacitor formed by the point E and the point F and the variable capacitor located between the point G and the point F may be the variable capacitor 106 disclosed in this embodiment of the present disclosure.

The grounding point H and the point E form a parallel-connected distributed inductor. The series-connected distributed capacitor, the variable capacitor, and the parallel-connected distributed inductor are in line with a right/left-handed transmission line principle. Therefore, a resonance frequency may be generated. The resonance frequency may be adjusted by changing a length of the distributed inductor. The length of the distributed inductor is generally less than one eighth of a wavelength of the resonance frequency. A value of the variable capacitor 106 is changed, so that impedance matching of the antenna is adjusted and the resonance frequency is adjusted.

The electronic device of the present invention may be specifically an entity, such as a mobile phone, a PDA, a tablet computer, or a notebook computer.

In this embodiment of the present invention, a low-frequency signal may cover a frequency band of LTE B20, and the high-frequency signal may cover a frequency band of LTE B1 B7 B3. It should be noted that this embodiment of the present disclosure is not limited to the foregoing frequency band ranges, and may include various other high and low frequency bands without departing from the idea of the present disclosure.

Therefore, according to the foregoing disclosed content, an electronic device disclosed in the embodiments of the present invention can implement a solution of an adjustable antenna of the electronic device that is provided with a metal frame. In the solution, not only appearance design of the metal frame of the electronic device can be better preserved, but also modifications on the metal frame can be avoided. Only a capacitance of a variable capacitor needs to be adjusted during debugging, greatly simplifying a debugging difficulty. In addition, sharing of high-frequency and low-frequency resonance frequencies of the present disclosure merely needs to use a part of the metal frame of the antenna resonance arm, and does not need to additionally use another metal frame to generate another frequency resonance, which can greatly reduce space needed by the antenna.

The foregoing descriptions are merely embodiments of the present disclosure, and are not intended to limit the scope of the present disclosure. An equivalent structural or equivalent process alternation made using the content of the specification and drawings of the present disclosure, or an application of the content of the specification and drawings directly or indirectly to another related technical field, shall fall within the protection scope of the present disclosure.

What is claimed is:

1. An electronic device comprising:

a metal frame;

an antenna ground;

an antenna resonance arm, wherein the antenna resonance arm is a part of the metal frame after segmentation, wherein the antenna resonance arm comprises a first end portion and a second end portion, wherein a first connection portion, a second connection portion, and a third connection portion are disposed on the antenna resonance arm, wherein the first connection portion is disposed on the first end portion of the antenna resonance arm, and wherein the third connection portion is between the first connection portion and the second connection portion;

a feeding branch disposed between the second connection portion and the antenna ground, wherein a feeding point and a variable capacitor are disposed on the feeding branch, and wherein the variable capacitor is disposed between the second connection portion and the feeding point;

a grounding branch disposed between the first connection portion and the antenna ground;

a short grounding branch disposed between the third connection portion and the antenna ground, wherein the short grounding branch is provided with a controlled switch; and a control circuit configured to:

control the controlled switch to be switched off or switched on; and when the control switch is switched off, generate a first resonance frequency by a part of the antenna resonance arm between the first connection portion and the second connection portion; and generate a second resonance frequency by a part of the antenna resonance arm between the second connection portion and the second end portion of the antenna resonance arm, wherein the first resonance frequency is lower than the second resonance frequency.

2. The electronic device of claim 1, wherein when the control switch is switched on, a third resonance frequency is generated by a part of the antenna resonance arm between the third connection portion and the second end portion of the antenna resonance arm.

3. The electronic device of claim 1, wherein the electronic device further comprises a first inductor arranged in parallel to the controlled switch.

4. The electronic device of claim 3, wherein an inductance of the first inductor comprises 5 nanoHenry (nH), 12 nH, or 11 nH.

5. The electronic device of claim 1, wherein the control circuit is further configured to adjust a capacitance of the variable capacitor, wherein the capacitance of the variable capacitor comprises 0.7 picoFarad (pF), 1.2 pF, 1.7 pF, 2.2 pF, or 2.7 pF.

6. The electronic device of claim 1, wherein the electronic device is cuboid, and wherein the metal frame is ring-shaped and is disposed on four side walls of the electronic device.

7. The electronic device of claim 1, wherein a distance between the first connection portion and the second connection portion is less than one eighth of a wavelength of the first resonance frequency.

8. The electronic device of claim 1, wherein the electronic device further comprises a first capacitor connected in parallel to the feeding point.

9. The electronic device of claim 1, wherein the electronic device further comprises a first inductor connected in series with the feeding point and the variable capacitor.

10. The electronic device of claim 9, wherein the first inductor is disposed between the feeding point and the variable capacitor.

11. The electronic device of claim 1, wherein the antenna resonance arm further has a fourth connection portion disposed between the first connection portion and the third connection portion, wherein the electronic device further comprises a second capacitor disposed between the fourth connection portion and the antenna ground, and wherein the fourth connection portion is connected to the antenna ground using the second capacitor.

12. An electronic device comprising:

a metal frame;

an antenna ground;

an antenna resonance arm, wherein the antenna resonance arm is a part of the metal frame after segmentation, wherein the antenna resonance arm comprises a first end portion and a second end portion, wherein a first connection portion, a second connection portion, and a third connection portion are disposed on the antenna resonance arm, wherein the first connection portion is disposed on the first end portion of the antenna resonance arm, and wherein the third connection portion is between the first connection portion and the second connection portion;

a feeding branch disposed between the second connection portion and the antenna ground, wherein a feeding point and a variable capacitor are disposed on the feeding branch, and wherein the variable capacitor is disposed between the second connection portion and the feeding point;

a grounding branch disposed between the first connection portion and the antenna ground;

a short grounding branch disposed between the third connection portion and the antenna ground, wherein the short grounding branch is provided with a controlled switch; and a control circuit configured to:

control the controlled switch to be switched off or switched on;

generate a first resonance frequency and a second resonance frequency by the antenna resonance arm when the controlled switch is switched off, wherein the first resonance frequency is lower than the second resonance frequency; and generate a third resonance frequency by the antenna resonance arm when the controlled switch is switched on.

13. The electronic device of claim 12, wherein the electronic device further comprises a first inductor arranged in parallel to the controlled switch.

14. The electronic device of claim 13, wherein a first inductance of the first inductor comprises 5 nanoHenry (nH), 12 nH, or 11 nH.

15. The electronic device of claim 12, wherein the control circuit is further configured to adjust a capacitance of the variable capacitor, and wherein the capacitance of the variable capacitor comprises 0.7 picoFarad (pF), 1.2 pF, 1.7 pF, 2.2 pF, or 2.7 pF.

16. The electronic device of claim 12, wherein the electronic device is cuboid, and wherein the metal frame is ring-shaped and is disposed on four side walls of the electronic device.

17. The electronic device of claim 12, wherein a distance between the first connection portion and the second connection portion is less than one eighth of a wavelength of the first resonance frequency.

18. The electronic device of claim 12, wherein the electronic device further comprises a first capacitor connected in parallel to the feeding point.

19. The electronic device of claim 12, wherein the electronic device further comprises a first inductor connected in series with the feeding point and the variable capacitor.

20. The electronic device of claim 19, wherein the first inductor is disposed between the feeding point and the variable capacitor.

21. The electronic device of claim 12, wherein the antenna resonance arm further has a fourth connection portion disposed between the first connection portion and the third connection portion, wherein the electronic device further comprises a second capacitor disposed between the fourth connection portion and the antenna ground, and wherein the fourth connection portion is connected to the antenna ground using the second capacitor.

22. An electronic device comprising:

a metal frame;

an antenna ground;

an antenna resonance arm, wherein the antenna resonance arm is a part of the metal frame after segmentation, wherein the antenna resonance arm comprises a first end portion and a second end portion, wherein the second end portion of the antenna resonance arm is an open end, wherein a first connection portion, a second connection portion, and a third connection portion are disposed on the antenna resonance arm, wherein the first connection portion is disposed on the first end portion of the antenna resonance arm, and wherein the third connection portion is between the first connection portion and the second connection portion;

a feeding branch disposed between the second connection portion and the antenna ground, wherein a feeding point and a variable capacitor are disposed on the feeding branch, and wherein the variable capacitor is disposed between the second connection portion and the feeding point;

a grounding branch disposed between the first connection portion and the antenna ground;

a short grounding branch disposed between the third connection portion and the antenna ground, wherein the short grounding branch is provided with a controlled switch; and a control circuit configured to control the controlled switch to be switched off or switched on.

23. The electronic device of claim 22, wherein the electronic device further comprises a first inductor arranged in parallel to the controlled switch.

24. The electronic device of claim 23, wherein a first inductance of the first inductor comprises 5 nanoHenry (nH), 12 nH, or 11 nH.

25. The electronic device of claim 22, wherein the control circuit is further configured to adjust a capacitance of the variable capacitor, wherein the capacitance of the variable capacitor comprises 0.7 picoFarad (pF), 1.2 pF, 1.7 pF, 2.2 pF, and 2.7 pF.

26. The electronic device of claim 22, wherein the electronic device is cuboid, and wherein the metal frame is ring-shaped and is disposed on four side walls of the electronic device.

27. The electronic device of claim 22, wherein a distance between the first connection portion and the second connection portion is less than one eighth of a wavelength of a first resonance frequency.

28. The electronic device of claim 22, wherein the electronic device further comprises a first capacitor connected in parallel to the feeding point.

29. The electronic device of claim 22, wherein the electronic device further comprises a first inductor connected in series with the feeding point and the variable capacitor.

30. The electronic device of claim 29, wherein the first inductor is disposed between the feeding point and the variable capacitor.

31. The electronic device of claim 22, wherein the antenna resonance arm further has a fourth connection portion disposed between the first connection portion and the third connection portion, wherein the electronic device further comprises a second capacitor disposed between the fourth connection portion and the antenna ground, and wherein the fourth connection portion is connected to the antenna ground using the second capacitor.

* * * * *